US011460795B2

(12) United States Patent
Ishizumi et al.

(10) Patent No.: US 11,460,795 B2
(45) Date of Patent: Oct. 4, 2022

(54) IMAGE FORMING APPARATUS

(71) Applicant: CANON KABUSHIKI KAISHA, Tokyo (JP)

(72) Inventors: Keisuke Ishizumi, Kanagawa (JP); Hiroko Yokoyama, Tokyo (JP); Shinji Katagiri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/398,539

(22) Filed: Aug. 10, 2021

(65) Prior Publication Data

US 2022/0066372 A1 Mar. 3, 2022

(30) Foreign Application Priority Data

Aug. 25, 2020 (JP) ..... JP2020-142115

(51) Int. Cl.
*G03G 15/00* (2006.01)
*G03G 15/043* (2006.01)

(52) U.S. Cl.
CPC ..... *G03G 15/5058* (2013.01); *G03G 15/043* (2013.01); *G03G 2215/00042* (2013.01)

(58) Field of Classification Search
CPC ..... G03G 15/04027; G03G 15/043; G03G 15/5041; G03G 15/5058; G03G 15/5054
See application file for complete search history.

(56) References Cited

U.S. PATENT DOCUMENTS

2011/0249277 A1* 10/2011 Kato ..... H04N 1/4055 358/1.1
2012/0086954 A1* 4/2012 Kawai ..... G03G 15/05 358/1.1
2014/0340696 A1* 11/2014 Muroi ..... G03G 15/5058 358/1.5
2015/0093132 A1* 4/2015 Muroi ..... G03G 15/5054 399/72

FOREIGN PATENT DOCUMENTS

JP H11308450 A 11/1999
JP 2005277808 A 10/2005
JP 2012084982 A 4/2012
JP 2012195715 A 10/2012
JP 2015066779 A 4/2015

* cited by examiner

*Primary Examiner* — Carla J Therrien
(74) *Attorney, Agent, or Firm* — Canon U.S.A., Inc. I.P. Division

(57) ABSTRACT

An image forming apparatus includes an image bearing member, an exposure unit, a developing member, and a control unit. The exposure unit exposes a surface of the image bearing member to light to form an electrostatic latent image. The developing member develops the electrostatic latent image by using toner to form a toner image. In image formation based on input image data, the control unit uses the exposure unit to control a maximum gradation value of the toner image to be formed on the image bearing member surface, based on a repetition length of a dither pattern. The control unit performs control so that the maximum gradation value is larger in a case where a first dither pattern having a first length as the repetition length is used than where a second dither pattern having a second length longer than the first length as the repetition length is used.

8 Claims, 15 Drawing Sheets

FIG.8A

| R | Y | M | C | K |
|---|---|---|---|---|
| 255 | 255 | 255 | 0 | 0 |
| 254 | 254 | 254 | 0 | 0 |
| 253 | 253 | 253 | 0 | 0 |
| 252 | 252 | 252 | 0 | 0 |
| 251 | 251 | 251 | 0 | 0 |
| 250 | 250 | 250 | 0 | 0 |
| ⋮ | ⋮ | ⋮ | ⋮ | ⋮ |
| 0 | 0 | 0 | 0 | 0 |

FIG.8B

| R | Y | M | C | K |
|---|---|---|---|---|
| 255 | 242 | 242 | 0 | 0 |
| 254 | 242 | 242 | 0 | 0 |
| 253 | 241 | 242 | 0 | 0 |
| 252 | 241 | 241 | 0 | 0 |
| 251 | 240 | 240 | 0 | 0 |
| 250 | 239 | 240 | 0 | 0 |
| ⋮ | ⋮ | ⋮ | ⋮ | ⋮ |
| 0 | 0 | 0 | 0 | 0 |

IMAGE FORMING APPARATUS

BACKGROUND OF THE DISCLOSURE

Field of the Disclosure

The present disclosure relates to an image forming apparatus using an electrophotographic method, such as a laser printer, a copying machine, and a facsimile.

Description of the Related Art

An electrophotographic method is known as an image recording method used for image forming apparatuses such as printers and copying machines. In the electrophotographic method, an electrophotographic process is performed to form an electrostatic latent image on a photosensitive drum with a laser beam and develop the electrostatic latent image with a charged coloring material (hereinafter referred to as toner) to form a developer image. The developer image is then transferred onto a recording material and fixed thereto, so that image formation is performed. In the case of a color image forming apparatus, a color image can be formed by overlapping coloring materials of a plurality of colors.

When the color image is formed, a dither matrix method may be used as a halftone expression method that periodically adjusts an exposure region area. Using the dither matrix method makes it possible to improve the color reproducibility of an output image, by correcting the characteristics of an image forming unit using a look-up table, acquiring a density curve, and adjusting the gradation of output image data corresponding to input image data. Particularly, as a technique for controlling the gradation, there is known a technique that controls the toner bearing amount corresponding to a solid image having a maximum density value in order to prevent the occurrence of image defects.

Japanese Patent Application Laid-Open No. 2012-84982 discusses a technique for controlling the amount of toner in a solid image, in which a patch pattern is formed by an image forming unit, a maximum density value is calculated based on output image data of the formed patch pattern, and the toner amount is controlled based on the difference between the calculated maximum density value and a preset maximum density value.

Japanese Patent Application Laid-Open No. 11-308450 discusses a technique for controlling the amount of toner in a solid image, in which image regions are determined based on information of input image data and a correction table is selected for each of the determined image regions.

As described above, the techniques discussed in Japanese Patent Application Laid-Open No. 2012-84982 and Japanese Patent Application Laid-Open No. 11-308450 control the toner consumption by uniformly correcting the data amount based on acquired image information regardless of color difference in order to prevent the occurrence of defective fixing. However, the techniques discussed in Japanese Patent Application Laid-Open No. 2012-84982 and Japanese Patent Application Laid-Open No. 11-308450 have an issue like the following. In a case where a correction table is generated based on output image data or input image data to control the toner amount, an image having a toner amount different from the target value may be formed with respect to the maximum density value set based on a result of the control, resulting in defective fixing.

SUMMARY OF THE DISCLOSURE

The present disclosure is directed to stably obtaining a toner amount necessary for image formation.

According to an aspect of the present disclosure, an image forming apparatus includes an image bearing member, an exposure unit configured to expose a surface of the image bearing member to light to form an electrostatic latent image, a developing member configured to develop the electrostatic latent image formed on the surface of the image bearing member by the exposure unit, by using toner, to form a toner image, and a control unit configured to perform control, wherein, in image formation based on input image data to be input, the control unit is configured to use the exposure unit to control a maximum gradation value of the toner image to be formed on the surface of the image bearing member, based on a repetition length of a dither pattern, wherein the control unit performs control so that the maximum gradation value is larger in a case where a first dither pattern having a first length as the repetition length is used than in a case where a second dither pattern having a second length longer than the first length as the repetition length is used.

Further features of the present disclosure will become apparent from the following description of exemplary embodiments with reference to the attached drawings.

BRIEF DESCRIPTION OF THE DRAWINGS

FIGS. 8A and 8B are tables each illustrating an example of a color table according to the first exemplary embodiment.

DESCRIPTION OF THE EMBODIMENTS

Exemplary embodiments of the present disclosure will be illustratively described in detail below with reference to the accompanying drawings. Sizes, materials, shapes, and relative arrangements of components described in the following exemplary embodiments may be modified as required depending on the configuration of an apparatus to which any of the exemplary embodiments is applied and the other various conditions. Unless otherwise specified, the scope of the present disclosure is not limited to the following exemplary embodiments.

<1. Image Forming Apparatus>

Figure 1:
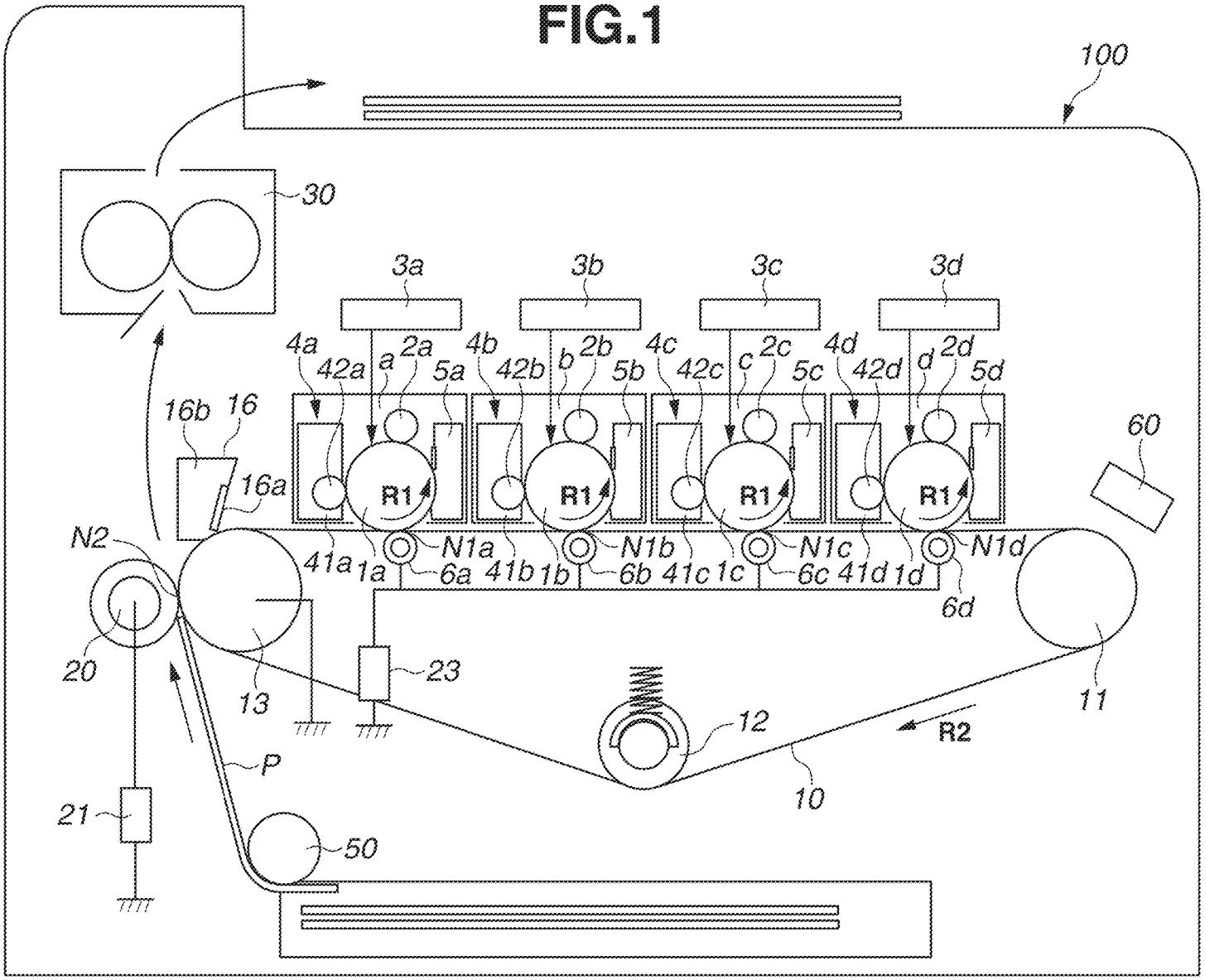
FIG. 1 is a cross-sectional view schematically illustrating a configuration of an image forming apparatus according to a first exemplary embodiment.

FIG. 1 is a cross-sectional view schematically illustrating a configuration of an image forming apparatus 100 according to a first exemplary embodiment. The image forming apparatus 100 according to the present exemplary embodiment is a tandem image forming apparatus including a plurality of image forming units a to d. The first image forming unit a, the second image forming unit b, the third image forming unit c, and the fourth image forming unit d form images by using toner of yellow (Y), magenta (M), cyan (C), and black (Bk), respectively. The four image forming units a to d are arranged in a line at equal spacings and have a substantially common configuration, except for the color of the toner contained therein. Thus, the image forming apparatus 100 according to the present exemplary embodiment will be described using the first image forming unit a as an example.

The first image forming unit a includes a photosensitive drum 1*a* as a drum-like photosensitive member, a charging roller 2*a* as a charging member, a developing unit 4*a*, and a drum cleaning unit 5*a*.

The photosensitive drum 1*a* is an image bearing member for bearing a toner image and is driven to rotate at a predetermined process speed (which is 200 mm/sec. in the present exemplary embodiment) in a direction indicated by an arrow R1 illustrated in FIG. 1. The developing unit 4*a* includes a developing container 41*a* that contains yellow toner, and a developing roller 42*a* serving as a developing member that bears the yellow toner contained in the developing container 41*a* and forms a yellow toner image on the photosensitive drum 1*a* with the yellow toner. The drum cleaning unit 5*a* collects toner adhering to the photosensitive drum 1*a*. The drum cleaning unit 5*a* includes a cleaning blade in contact with the photosensitive drum 1*a*, and a waste toner box that contains toner removed from the photosensitive drum 1*a* by the cleaning blade.

When a direct current (DC) controller (or a control unit) 274 (see FIG. 2) receives an image signal and starts an image forming operation, the photosensitive drum 1*a* is driven to rotate. During the rotation, the photosensitive drum 1*a* is uniformly charged to a predetermined potential (a dark portion potential Vd) with a predetermined polarity (a negative polarity in the present exemplary embodiment) by the charging roller 2*a*, and is exposed to light corresponding to the image signal by an exposure unit 3*a*. Accordingly, an electrostatic latent image corresponding to the yellow color component image of a target color image is formed. The electrostatic latent image is then developed at a developing position by the developing roller 42*a*, so that the latent image is visualized as a yellow toner image (hereinafter simply referred to as a toner image). The developing roller 42*a* rotates at a process speed of 300 mm/sec., which is 1.5 times faster than the process speed of the photosensitive drum 1*a*, in the same direction as the rotation direction of the photosensitive drum 1*a*, so that the latent image on the photosensitive drum 1*a* is stably developed.

In this example, the normal charging polarity of the toner borne by the developing roller 42*a* is the negative polarity. In the present exemplary embodiment, the electrostatic latent image is subjected to reversal development by using the toner charged to the same polarity as the charging polarity of the photosensitive drum 1*a* by the charging roller 2*a*. However, in the present exemplary embodiment, an image forming apparatus that performs normal development on the electrostatic latent image by using toner charged to the polarity opposite to the charging polarity of the photosensitive drum 1*a* may also be used.

An intermediate transfer belt 10 serves as an endless intermediate transfer member having a movable surface, and is disposed so as to be in contact with the respective photosensitive drums 1*a* to 1*d* of the image forming units a to d. The intermediate transfer belt 10 is stretched by three stretching members: a support roller 11, a stretching roller 12, and a facing roller 13. The intermediate transfer belt 10 is stretched with a total tension of 60N by the stretching roller 12, and is moved in a direction indicated by an arrow R2 illustrated in FIG. 1 by the facing roller 13 being rotated by a driving force.

The volume resistivity of the intermediate transfer belt 10 according to the present exemplary embodiment is $1\times10^{10}$ Ω·cm. The volume resistivity is measured by connecting a UR probe (MCP-HTP12) to Hiresta-UP (MCP-HT450) from Mitsubishi Chemical Corporation and applying a voltage of 100 V for 10 seconds. More specifically, the volume resistivity of the intermediate transfer belt 10 is measured after being left for four hours in a measurement chamber with an ambient temperature set to 23° C. and a humidity set to 50%.

While the toner image formed on the photosensitive drum 1*a* passes through a primary transfer portion N1*a* where the photosensitive drum 1*a* and the intermediate transfer belt 10 are in contact with each other, the toner image is primarily transferred onto the intermediate transfer belt 10 by application of a positive polarity voltage to a primary transfer roller 6*a* from a primary transfer power source (or a primary transfer high voltage power source) 23. Meanwhile, residual toner on the photosensitive drum 1*a*, which is not primarily transferred onto the intermediate transfer belt 10, is collected and removed from the surface of the photosensitive drum 1*a* by the drum cleaning unit 5*a*.

The primary transfer roller 6*a* is disposed at a position facing the photosensitive drum 1*a* via the intermediate transfer belt 10, and serves as a primary transfer member (contact member) in contact with the inner circumferential surface of the intermediate transfer belt 10. The primary transfer power source 23 is capable of applying a positive or negative polarity voltage to each of the primary transfer rollers 6*a* to 6*d*. While in the present exemplary embodiment, the configuration in which the common primary transfer power source 23 applies a voltage to each of the plurality of primary transfer members is described, the configuration is not limited thereto. A configuration in which a plurality of primary transfer power sources is provided for each of the primary transfer members may also be used.

Likewise, a second color (magenta) toner image, a third color (cyan) toner image, and a fourth color (black) toner image are formed and then sequentially transferred onto the intermediate transfer belt 10 so as to overlap one another. Accordingly, four-color toner images corresponding to the target color image are formed on the intermediate transfer belt 10. Subsequently, while the four-color toner images borne on the intermediate transfer belt 10 pass through a secondary transfer portion N2 formed by a secondary transfer roller 20 and the intermediate transfer belt 10 that are in contact with each other, the four-color toner images are secondarily transferred at once onto the surface of a transfer material (a recording material) P supplied by a paper feeding unit 50.

The secondary transfer roller 20 with an outer diameter of 18 mm is formed of a nickel-plating steel bar with an outer diameter of 8 mm, and a foam sponge material that entirely covers the nickel-plating steel bar. The foam sponge material is mainly made of nitril-butadiene rubber (NBR) and epichlorohydrin rubber, and has a volume resistivity of 108 Ω·cm and a thickness of 5 mm. The rubber hardness of the foam sponge material is 30 degrees, which is measured by using an Asker type C hardness meter and applying a 500 g load. The secondary transfer roller 20 is in contact with the outer circumferential surface of the intermediate transfer belt 10 and forms the secondary transfer portion N2. The secondary transfer roller 20 is pressed against the facing roller 13 disposed at a position facing the secondary transfer roller 20 via the intermediate transfer belt 10, with a pressing force of 50 N.

The secondary transfer roller 20 is driven to rotate by the intermediate transfer belt 10. When a voltage is applied to the secondary transfer roller 20 from a secondary transfer power source (or a secondary transfer high voltage power source) 21, a current flows from the secondary transfer roller 20 to the facing roller 13. Accordingly, the toner image borne on the intermediate transfer belt 10 is secondarily transferred onto the transfer material P at the secondary transfer portion N2. When the toner image on the intermediate transfer belt 10 is secondarily transferred onto the transfer material P, the voltage applied to the secondary transfer roller 20 from the secondary transfer power source 21 is controlled so that a constant current flows from the secondary transfer roller 20 to the facing roller 13 via the intermediate transfer belt 10. The magnitude of the current required for the secondary transfer is predetermined depending on the ambient environment where the image forming apparatus 100 is installed and the type of the transfer material P. The secondary transfer power source 21 is connected with the secondary transfer roller 20, and applies a transfer voltage to the secondary transfer roller 20. The secondary transfer power source 21 is capable of outputting a voltage from 100 V to 4,000 V.

The transfer material P with the four-color toner images transferred thereon by the secondary transfer is heated and pressurized by a fixing unit 30, and the four color toners melt and mix and are fixed to the transfer material P. Meanwhile, residual toner on the intermediate transfer belt 10 after the secondary transfer is cleaned and removed by a belt cleaning unit (a collection unit) 16 disposed on the downstream side of the secondary transfer portion N2 in the moving direction of the surface of the intermediate transfer belt 10. The belt cleaning unit 16 includes a cleaning blade 16*a* as a contact member that is in contact with the outer circumferential surface of the intermediate transfer belt 10 at a position facing the facing roller 13, and a waste toner container 16*b* that contains the toner collected by the cleaning blade 16*a*.

In the image forming apparatus 100 according to the present exemplary embodiment, a full-color print image is formed on the transfer material P through the above-described operation.

<2. Control Block Diagram>

Control according to the present exemplary embodiment will be described next with reference to FIG. 2.

Figure 2:
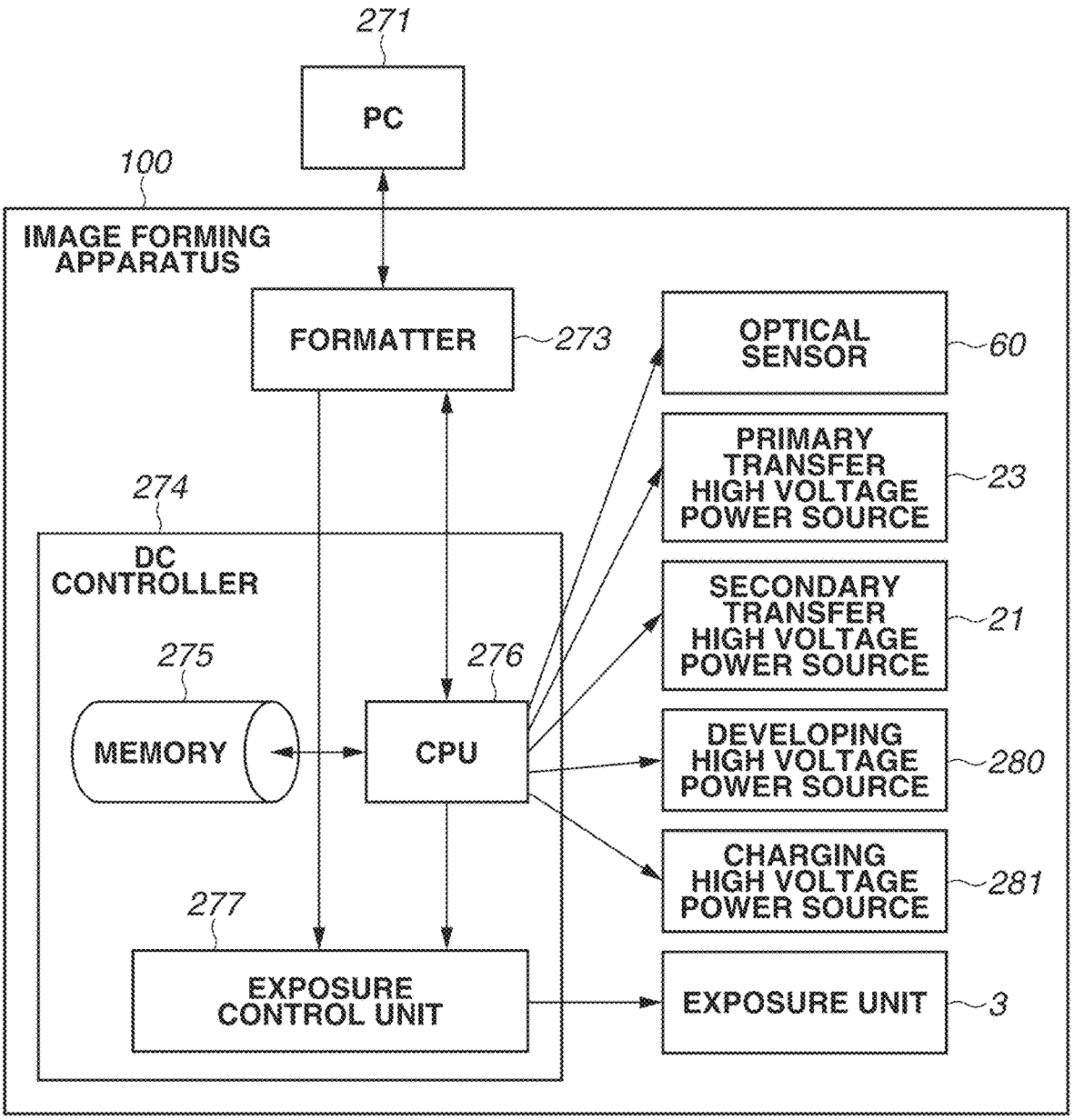
FIG. 2 is a block diagram illustrating control of operation of the image forming apparatus according to the first exemplary embodiment.

FIG. 2 is a control block diagram illustrating control of operation of the image forming apparatus 100. A personal computer (PC) 271 serving as a host computer issues a print instruction to a formatter 273 serving as a conversion unit inside the image forming apparatus 100, and transmits image data of an image to be printed, to the formatter 273. The formatter 273 receives red, green, and blue (RGB) image data or cyan, magenta, yellow, and black (CMYK) image data from the PC 271 and converts the image data into CMYK exposure data according to the modes (settings) specified by the PC 271. The exposure data obtained by the conversion at this time has a resolution of 600 dots per inch (dpi). The modes specified by the PC 271 include modes related not only to paper type and paper size, but also to image quality, and a mode for changing the screen ruling of a dither pattern (described below).

The formatter 273 transfers the exposure data obtained by the conversion to an exposure control unit 277 serving as an exposure control device inside the DC controller 274. The exposure control unit 277 controls each of the exposure units 3*a* to 3*d* (hereinafter also collectively referred to as the exposure unit 3) according to an instruction from a central processing unit (CPU) 276. The image forming apparatus 100 illustrated in FIG. 2 performs halftone control by adjusting the exposure area and the non-exposure area in the exposure data. When the CPU 276 receives the print instruction from the formatter 273, the CPU 276 starts an image formation sequence. The DC controller 274 mounts therein the CPU 276, a memory 275, and the like, and performs programmed operations. The CPU 276 controls a charging high voltage power source 281, a developing high voltage power source 280, the primary transfer high voltage power source 23, the secondary transfer high voltage power source 21, and the exposure unit 3 to control the formation of an electrostatic latent image and the transfer of a toner image, so that image formation is performed.

The CPU 276 also performs processing for receiving a signal from an optical sensor 60 that serves as a detection unit in correction control for correcting the position and density of an image to be formed by the image forming apparatus 100. In the image correction control, the optical sensor 60 measures the amount of reflected light from a test patch (a toner image for detection) 400 (see FIG. 4) formed on the outer circumferential surface of the intermediate transfer belt 10 at a position facing the optical sensor 60. A detection signal of the optical sensor 60 is subjected to analog-to-digital (A/D) conversion via the CPU 276 and stored in the memory 275. The DC controller 274 performs calculation by using the detection result by the optical sensor 60 to perform various kinds of corrections.

The formatter 273 generates a correction curve that enables obtaining a desired density curve, based on a result of detecting the test patch 400 (a pattern for density detection to be described below).

<3. Halftone Expression>

A halftone expression method will be described next with reference to FIGS. 3A to 3C.

The image forming apparatus 100 according to the present exemplary embodiment uses multi-value data to generate output image data for each pixel. The exposure data is transmitted to the exposure control unit 277 to expose each of the photosensitive drums 1*a* to 1*d* (hereinafter also collectively referred to as the photosensitive drum 1) to light based on input image data. Because the charging of toner and the photosensitive drum 1 can be easily affected by the ambient temperature and humidity, it is difficult to appropriately express a halftone density for isolated pixels using continuous tone. Thus, in the present exemplary embodiment, a stable halftone expression is implemented by adjusting the dot size using area modulation of a pixel block instead of using continuous tone. FIGS. 3A and 3B each illustrate an example in which an exposure region area is adjusted for halftone expression. FIG. 3A illustrates a dither pattern in which the repetition cycle of an exposure region is large, and FIG. 3B illustrates a dither pattern in which the repetition cycle of an exposure region is small. FIGS. 3A and 3B illustrate cases of an area coverage modulation of 25% and 33%, respectively, assuming that the area coverage modulation of a solid image (having a maximum gradation value) is 100%. As described above, a halftone expression method that periodically adjusts the exposure region area is referred to as a dither matrix method, and a shape that forms the minimum unit of a repetitive pattern is referred to as a dither matrix. FIGS. 3A and 3B both illustrate cases where the dither matrix is square. A screen ruling L1 of a dot pattern formed of a square dither matrix will be described next.

Figure 3C:
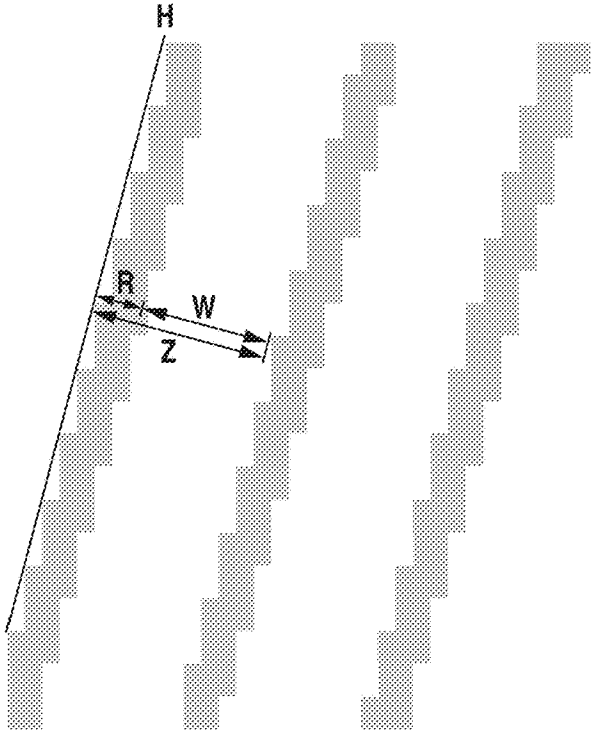
FIGS. 3A to 3C are diagrams each illustrating a halftone expression using a dither matrix according to the first exemplary embodiment.
Figure 3B:
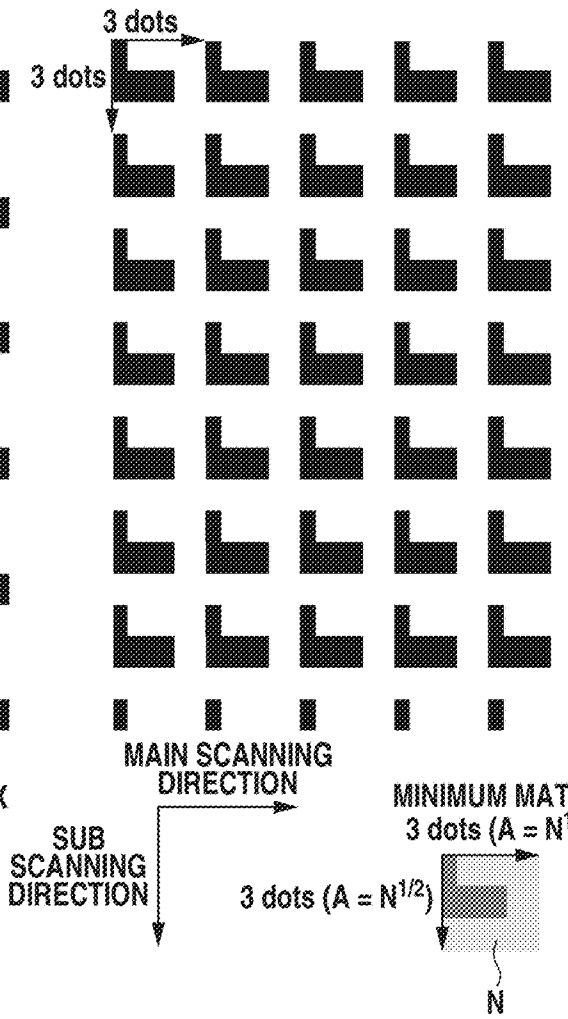
Figure 3A:
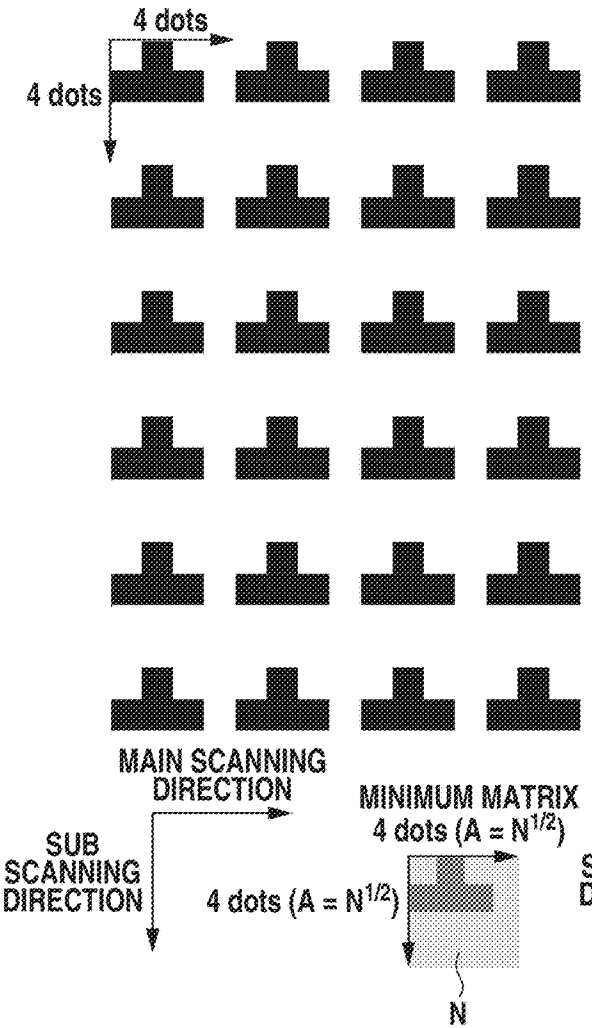

In the dither matrix method, the screen ruling L1 of a dot pattern in a dither pattern like those illustrated in FIGS. 3A and 3B is calculated as follows. Assume that the number of pixels that form the side (one side) of the dither matrix in the main scanning direction is A dots. In a case where the dither matrix is square, the number of pixels that form the side (the other side) in the sub scanning direction is also A dots, and the pixel area of the dither matrix is represented by $A^2=N$. Assuming that image resolution is represented by I (which is expressed in dpi), the screen ruling L1 of the dot pattern can be calculated by dividing the image resolution I by the square root of the pixel area N of the dither matrix, as represented by formula (1).

$$\text{Screen ruling } L1 \text{ of dot pattern} = I/N^{1/2} \quad (1)$$

$N^{1/2}$ denotes the number of pixels A of one side of the dither matrix. This means that the repetitive pattern is formed every A dots. The number of repetitions of the repetitive pattern of the dither matrix of the dot pattern in the image resolution I dpi is defined as the screen ruling L1 of the dot pattern, which is represented by formula (1). In the present exemplary embodiment, an image resolution of 600 dpi of the image forming apparatus 100 is assigned to the image resolution I. The unit of the screen ruling L1 is lines per inch (lpi). In FIG. 3A, a repetition length (=A) of the dot pattern (which is defined by the minimum distance between same positions of a first dither matrix and a second dither matrix different from the first dither matrix) is 4 dots in each of the main and sub scanning directions. Thus, the pixel area N of the dither matrix is 16 dots, and the screen ruling L1 in FIG. 3A is 150 lpi. Also in FIG. 3B, the repetition length is 3 dots in each of the main and sub scanning directions and the pixel area N of the dither matrix is 9 dots. Thus, the screen ruling L1 in FIG. 3B is 200 lpi.

The definition of the screen ruling of a square dither matrix in a dot pattern has been described above with reference to FIGS. 3A and 3B. The screen ruling of a parallelogram dither matrix in a dot pattern will be described next. The parallelogram dither matrix refers to a dither matrix having repetition lengths formed of two grating vectors having angles relative to the main and the sub scanning directions. Such a dither matrix has vectors having different lengths, and thus the repetition length to be repeated is different between the major- and the minor-axis vectors. Accordingly, the screen ruling of the parallelogram dither matrix has a different value depending on which of the major- and the minor-axis vectors is selected. Thus, for the parallelogram dither matrix, the pixel area N of the dither matrix in the parallelogram is calculated. Then, assuming that the parallelogram is a square, the lengths correlating with the major and minor axes are calculated, and the screen ruling is calculated using formula (1). The screen ruling calculated using formula (1) is defined as the screen ruling of the parallelogram dither matrix. In other words, assuming that the parallelogram is a square, the square root of the pixel area N is calculated in a similar way to the case of the square dither matrix, so that the geometric mean of the repetition lengths for the repetition of the major- and minor-axis vectors is calculated. In the present exemplary embodiment, examples of a method for counting the pixel area N of the dither matrix in the parallelogram include a method in which, if at least a half of the area of a pixel is positioned on the grating vectors, the pixel is counted as a pixel in the parallelogram. This enables appropriate calculation of the pixel area N of the parallelogram dither matrix. Any counting method is applicable as long as the pixel area N of each of the repeated parallelogram dither matrices is counted as the same number.

In a case where the parallelogram has a large difference between the lengths of the major- and the minor-axis vectors that form the parallelogram, the definition of the screen ruling is not limited to the above-described one, and the screen ruling defined based on the minor-axis vector may be adopted. For example, if the difference between the lengths of the major- and the minor-axis vectors is 1 dot or more, the screen ruling defined based on the major-axis vector is different from the screen ruling defined based on the minor-axis vector. In this case, rather than taking the geometric mean, adopting the screen ruling defined based on the minor-axis vector, i.e., the larger screen ruling in the parallelogram dither pattern may enable control (described below) with higher accuracy.

As described above, the dither matrix illustrated in each of FIGS. 3A and 3B is formed of a dot pattern. Alternatively, the dither matrix may be formed of a line pattern, as illustrated in FIG. 3C. When the screen ruling of a dither pattern having such a dither matrix is calculated, the repetition length in the line direction cannot be defined. Thus, a value obtained by dividing the image resolution I by a sum Z of a distance W between lines and the number of pixels R per line is defined as a screen ruling L2 of the line pattern. The sum Z, the distance W, and the number of pixels R are expressed in dots. The screen ruling L2 of the line pattern can be represented by formula (2).

$$\text{Screen ruling } L2 \text{ of line pattern} = I/Z \quad (2)$$

As illustrated in FIG. 3C, the distance W between the lines is the length of the line segment corresponding to the shortest distance between one line and another adjacent line (the length in the direction perpendicularly intersecting each of the lines). The number of pixels R per line is the number of pixels corresponding to the short width of the line pattern through which a line extending from the line segment (distance) W passes, as illustrated in FIG. 3C. The sum Z is defined as the repetition length of the dither matrix that has been mentioned in the description of the screen ruling L1 of the dot pattern. In calculating the screen ruling L2 of the line pattern, a matrix that forms the image resolution I is defined to be formed of an axis horizontal to the sum Z and an axis H perpendicularly intersecting the axis. Because the screen ruling L2 changes depending on the matrix setting for the image resolution I, the above-described definition is made so that the largest screen ruling is obtained.

The screen ruling of the dither pattern can be confirmed by observing the surface of the transfer material P with halftones printed thereon with a microscope, and obtaining a result of measuring the dots or the distance W between the lines. A result of screen ruling measurement using a commercial screen ruling gauge may be used as the screen ruling of the dither pattern. For example, the IGS screen ruling meter sold by Insatsu Gakkai Shuppanbu Ltd., Tokyo, Japan is capable of measuring a screen ruling ranging from 50 to 800 lpi.

In the present exemplary embodiment, the index indicating the repetition length of the dither pattern is not limited to the above-described one as long as the index indicates the correlation of the distance between dither matrices each forming the minimum repetition unit of the dither pattern.

<4. Density Control Method>

A density control method according to the present exemplary embodiment will be described next with reference to FIGS. 4, 5, and 6.

Figure 4:
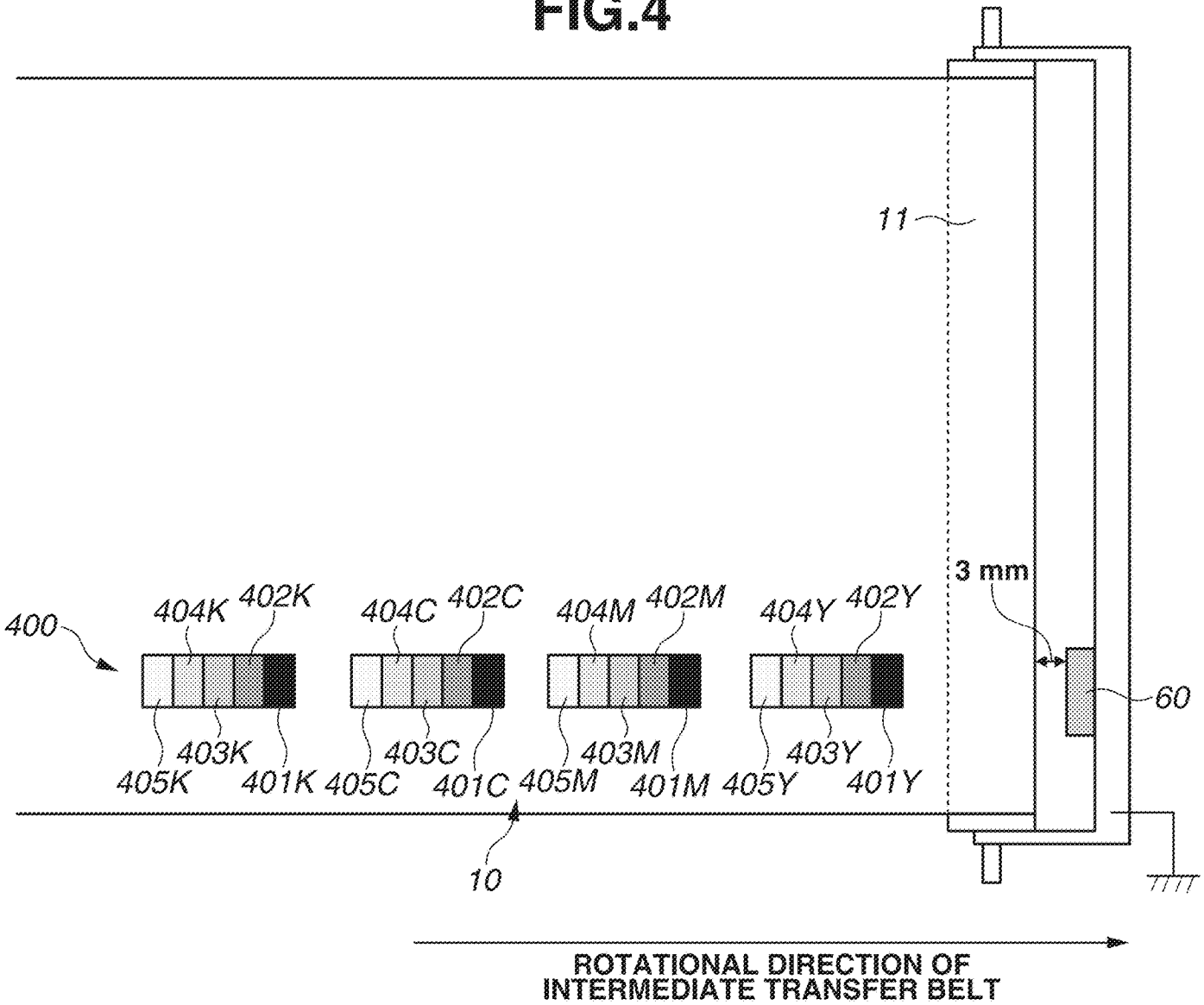
FIG. 4 is a schematic diagram illustrating an arrangement and configuration of a test patch detection unit according to the first exemplary embodiment.
Figure 5:
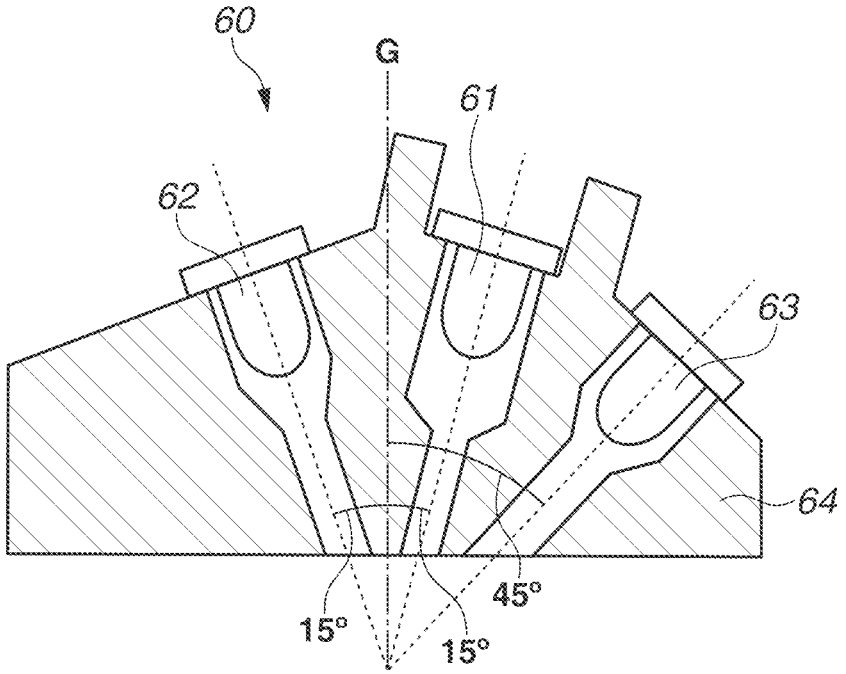
FIG. 5 is a cross-sectional view illustrating the configuration of the test patch detection unit according to the first exemplary embodiment.

FIG. 4 schematically illustrates a positional relationship between the test patch 400 formed on the intermediate transfer belt 10 and the optical sensor 60 in density adjustment control for adjusting the density of an image according to the present exemplary embodiment. As the test patch 400 for the density adjustment control, five different patches 401, 402, 403, 404, and 405 having different gradations are formed for each of yellow (Y), magenta (M), cyan (C), and black (K). The test patch 400 starts with the solid patch 401 (with an area coverage modulation of 100%) for positioning, followed by the patches 402, 403, 404, and 405 with an area coverage modulation of 80%, 60%, 40%, and 20%, respectively. While in the present exemplary embodiment, the five patches 401, 402, 403, 404, and 405 having different gradations are formed (six measurement conditions including an area coverage modulation of 0% are set), the number of patches can be suitably set.

A method for detecting the test patch 400 will be described next with reference to FIG. 5. The optical sensor 60 detects reflected light from the outer circumferential surface of the intermediate transfer belt 10 and the test patch 400. FIG. 5 schematically illustrates a configuration of the optical sensor 60. As illustrated in FIG. 4, the optical sensor 60 is held by a stay serving as a holding member, and the distance between the optical sensor 60 and the surface of the intermediate transfer belt 10 is 3 mm. As illustrated in FIG. 5, the optical sensor 60 includes a light-emitting element 61 such as a light emitting diode (LED), light-receiving elements 62 and 63 such as phototransistors, and a holder 64. The light-emitting element 61 is disposed to be inclined by 15 degrees with respect to a direction (a line G illustrated in FIG. 5) perpendicular to the surface of the intermediate transfer belt 10 and irradiates the test patch 400 on the intermediate transfer belt 10 and the surface of the intermediate transfer belt 10 with infrared light (having a wavelength of 800 nm). The region irradiated with the infrared light is a detection region. The holder 64 is adjusted in shape so that the spot diameter is 2 mm when the intermediate transfer belt 10 is irradiated with the infrared light by the light-emitting element 61. The light-receiving element 63 is disposed to be inclined by 45 degrees with respect to the direction (the line G illustrated in FIG. 5) perpendicular to the surface of the intermediate transfer belt 10, and receives diffuse reflected infrared light from the test patch 400 and the surface of the intermediate transfer belt 10. The light-receiving element 62 is disposed to be inclined by 15 degrees with respect to the direction (the line G illustrated in FIG. 5) perpendicular to the surface of the intermediate transfer belt 10, and receives regular reflected infrared light and diffuse reflected infrared light from the test patch 400 and the surface of the intermediate transfer belt 10.

Figure 6:
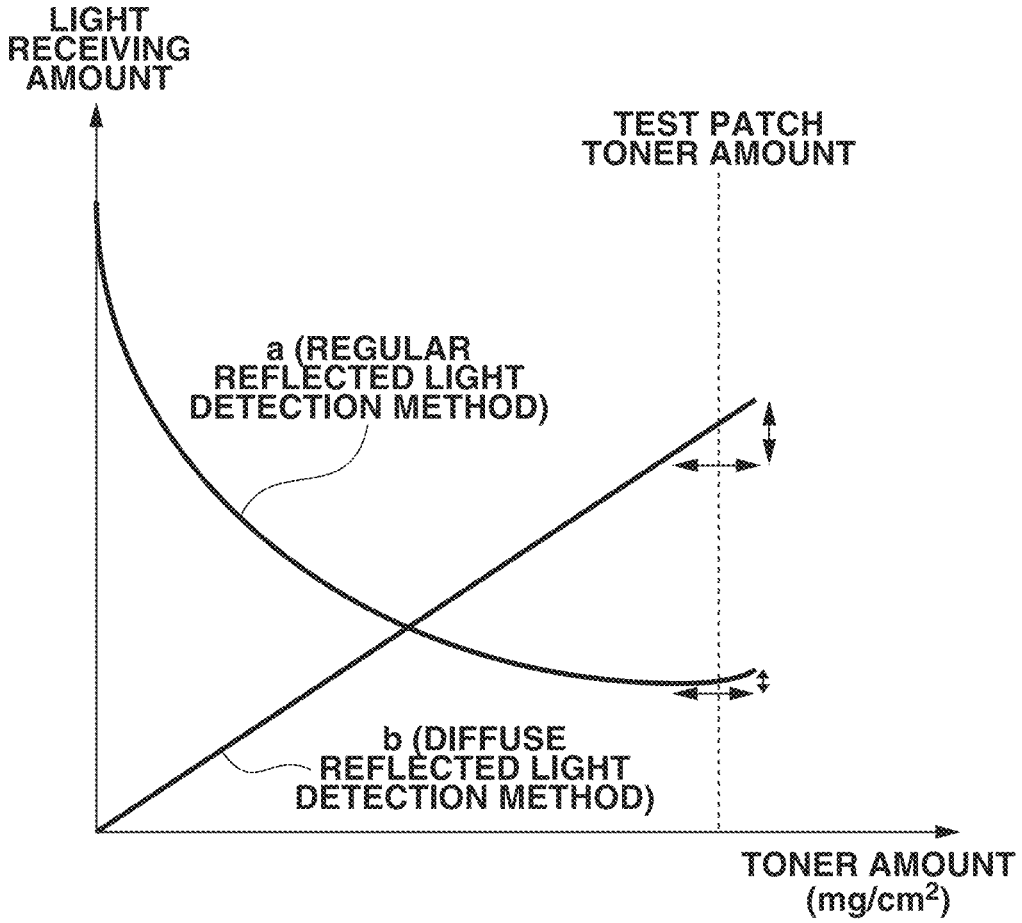
FIG. 6 is a graph illustrating changes in light receiving amounts of a diffuse reflected light receiving element and a regular reflected light receiving element according to the first exemplary embodiment.

FIG. 6 illustrates detection results obtained when a regular reflected light detection method and a diffuse reflected light detection method are used in the density detection control. A curve a illustrated in FIG. 6 indicates a detection result from the light-receiving element 62 that receives regular reflected light when the test patch 400 is detected. When the toner amount is small, the detection output decreases as the toner amount increases. However, when the toner amount increases, the decreased amount of the detection output gradually decreases. When the toner amount further increases, the detection output starts increasing. More specifically, as the toner amount increases, the amount of regular reflected light from the intermediate transfer belt 10 decreases and as a result, the detection output decreases. Meanwhile, the amount of diffuse reflection light from the toner increases. When the toner amount exceeds a certain level, the amount of diffuse reflected light exceeds the amount of regular reflected light, resulting in the increase in the detection output. For this reason, the toner amount and the detection output are not in one-to-one correspondence with each other, and thus optimum density correction cannot be performed only by regular reflected light detection. On the other hand, a line b illustrated in FIG. 6 indicates a detection result from the light-receiving element 63 that receives diffuse reflected light. The light receiving amount linearly increases as the toner amount increases. This is because the amount of diffuse reflected light increases as the toner amount increases. In diffuse reflected light detection, the toner amount and the detection output are in one-to-one correspondence with each other. However, the black toner absorbs almost all infrared light, and the detection output corresponding to the toner amount is small. Accordingly, a large error occurs when the detection output and the toner amount are in one-to-one correspondence with each other, and thus optimum density correction cannot be performed only by diffuse reflected light detection. Therefore, in the present exemplary embodiment, results of both the regular reflected light detection and the diffuse reflected light detection are used. More specifically, in the present exemplary embodiment, the detection output of regular reflected light and the detection output of diffuse reflected light from the solid toner test patch 401 with an area coverage modulation of 100% are normalized to be equal to each other, and the difference between the output of regular reflected light and the output of diffuse reflected light is obtained to calculate the net amount of regular reflected light. Through this calculation, a one-to-one correspondence can be made between the toner amount and the detection result for all of yellow, magenta, cyan, and black using the same calculation method, so that density correction is performed for each color based on a result of the correspondence.

The detection result of the test pattern 400 is processed by the DC controller 274 serving as a control unit. A received light amount signal from the optical sensor 60 is subjected to analog-to-digital (A/D) conversion and then output to the DC controller 274. The CPU 276 in the DC controller 274 calculates the net amount of regular reflected light. Based on a result of the calculation, the DC controller 274 determines density factors such as the charging voltage, the developing voltage, and the exposure light amount. A result of setting the density factors is stored in the memory 275 inside the DC controller 274, and used in regular image formation and the next density control.

<5. Method for Setting of Maximum Gradation Limit>

A method for setting a maximum gradation limit according to the present exemplary embodiment will be described next with reference to FIGS. 7, 8A, 8B, 9A, and 9B.

A density control process will be described first.

Figure 7:
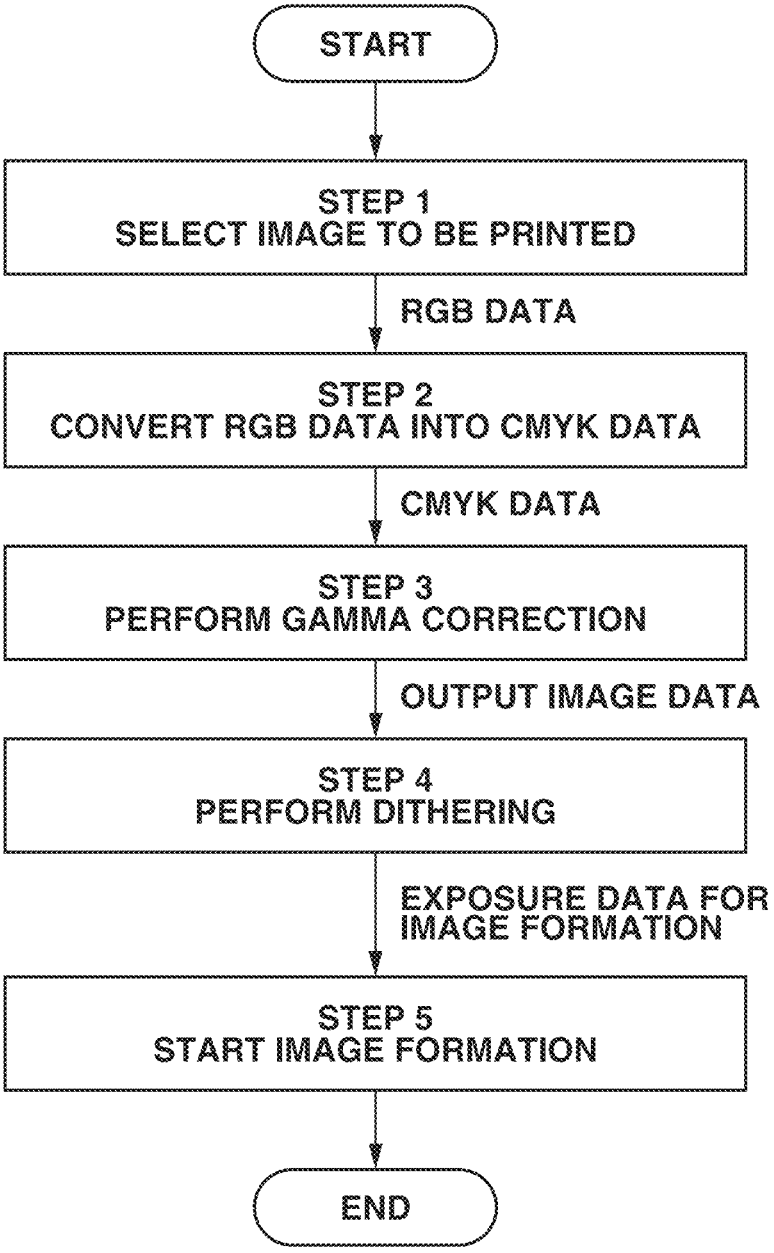
FIG. 7 is a flowchart illustrating processing before image formation according to the first exemplary embodiment.

FIG. 7 is a flowchart illustrating processing for generating output image data, which is to be used by the image forming apparatus 100 according to the present exemplary embodiment to draw an image, based on input image data received from the PC 271.

In step 1, a user selects an image to be printed, on the PC 271, and the PC 271 transmits RGB data as input image data to the formatter 273. In step 2, the formatter 273 converts the received RGB data into CMYK data based on a color table prepared in advance. FIG. 8A illustrates an example of the color table. More specifically, FIG. 8A illustrates a part of a table for converting R data into CMYK data. The image data illustrated in FIG. 8A is expressed in 256 gradations. In the present exemplary embodiment, the CMYK data for representing R data is formed of Y data and M data in the same ratio and uses none of C data and K data. Since the color table illustrated in FIG. 8A is an example, the user may set the ratio of the conversion into CMYK data to any value based on the characteristics of the image forming apparatus 100 and the characteristics of toner as a coloring material.

The input image data to be transmitted to the formatter 273 may be CMYK data. In this case, the formatter 273 converts the CMYK data into RGB data and then converts the RGB data into CMYK data based on the color table. The formatter 273 may directly convert the CMYK data into CMYK data without conversion into RGB data.

In step 3, the formatter 273 generates the output image data corresponding to the CMYK data based on gamma correction control that has been performed in advance in density control or the like.

Figure 9A:
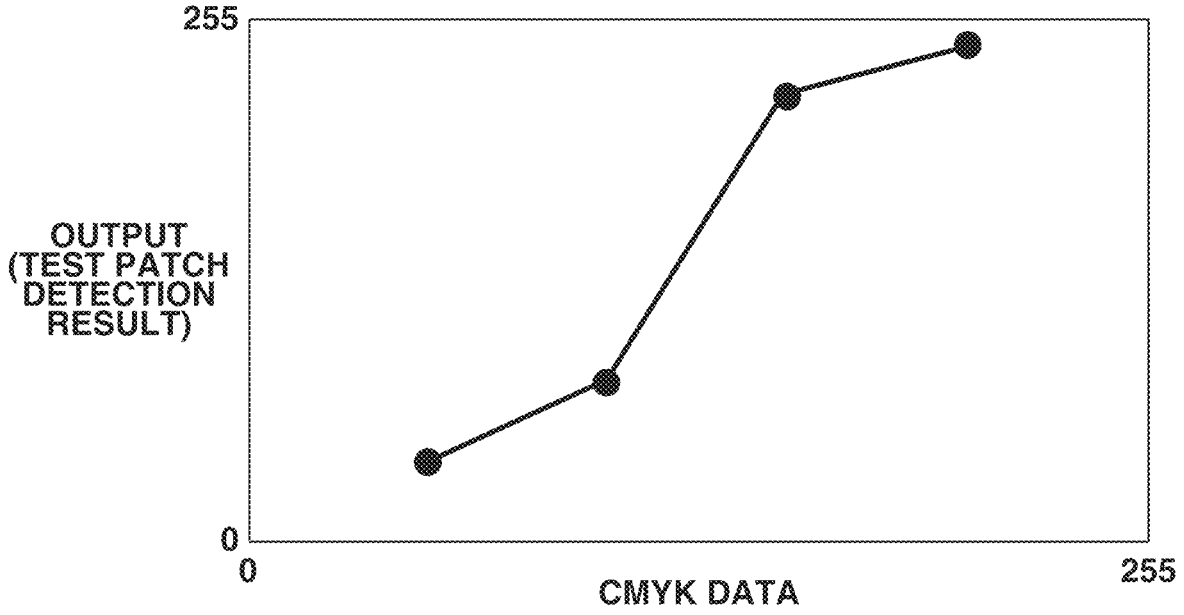
FIGS. 9A and 9B are graphs illustrating a gamma correction according to the first exemplary embodiment.
Figure 9B:
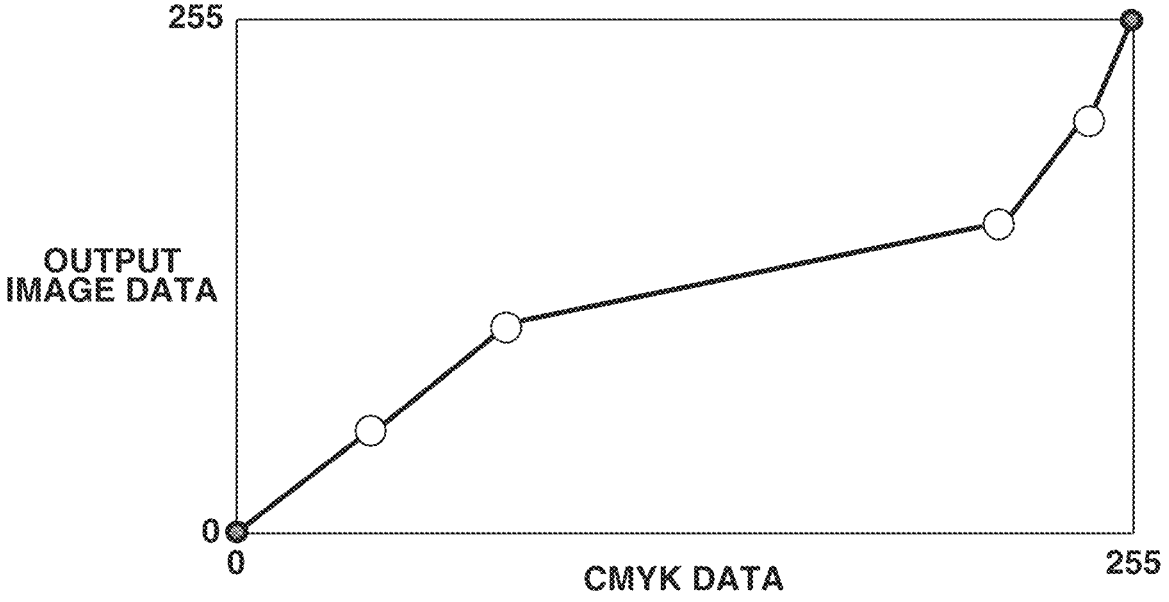

In the present exemplary embodiment, gamma correction is performed based on a result of the density control. The DC controller 274 calculates the output data of the test patch 400 read by the optical sensor 60 into the density. Then, the formatter 273 receives the calculation result and performs the gamma correction. FIGS. 9A and 9B illustrate examples of results of detecting the test patch 400 in the density control. Referring to FIG. 9A, the horizontal axis indicates the data of any one of the colors in the CMYK data, and is represented in 256 gradations. The maximum value of the horizontal axis is 255, which corresponds to a solid image having an area coverage modulation of 100%. As described above, in the present exemplary embodiment, the test patch 400 includes the patches 402, 403, 404, and 405 having an area coverage modulation of 80%, 60%, 40%, and 20%, respectively.

The vertical axis illustrated in FIG. 9A indicates a density value obtained by conversion based on the output value of the net amount of regular reflected light from the test patch 400 detected by the optical sensor 60. The output value of the solid patch 401 detected by the optical sensor 60 is defined as 0, and the density at this time is defined as 255. The method for detecting the test patch 400 is a known method in which the amount of regular reflected light is obtained from the amount of light received by a regular reflected light sensor and by a diffuse reflected light sensor to measure the density. The DC controller 274 performs control so that the amount of regular reflected light increases with lower density of the test patch 400 and decreases with higher density of the test patch 400. The CPU 276 in the DC controller 274 calculates the net amount of regular reflected light upon detection of the test patch 400, and transmits the calculation result to the formatter 273. The formatter 273 performs correction for the output image data corresponding to the CMYK data.

FIG. 9B illustrates gamma correction processing according to the present exemplary embodiment. The horizontal axis indicates the CMYK data represented in 256 gradations. The vertical axis indicates the output image data to be output as a result of applying the gamma correction processing to the CMYK data. In the present exemplary embodiment, an output table of an inverse function is generated for the detection result of the test patch 400, and the detection result is corrected to obtain the density which is linear to the CMYK data. In the present exemplary embodiment, linear combination is performed between data items of the test patch 401. In the example of FIG. 9B, the correction is performed so that the output image data has a value of zero at the point where the CMYK data has a value of zero, and the output image data has a value of 255 at the point where the CMYK data has a value of 255. At this time, linear interpolation may not necessarily be performed between the test patches 400. For example, to express a halftone with high color saturation, the output image data may be offset at a predetermined rate with respect to the CMYK data, starting with the value determined by linear interpolation. In addition, linear approximation may be performed on all the values obtained with the test patch 400.

In step 4, dither processing (dithering) is performed. Exposure data for image formation, which corresponds to the dither pattern, is generated so that exposure is performed at the area coverage modulation ratio corresponding to the output image data.

In step 5, based on the exposure data for image formation, the exposure unit 3 exposes the photosensitive drum 1 to light to form an electrostatic latent image. After a series of electrophotographic image forming processes, a print image is formed on the transfer material P such as paper.

Each of steps 2, 3, and 4 in FIG. 7 is a filtering process for converting the CMYK data as input image data obtained by converting the RGB data, into output image data. Maximum gradation limitation processing (described below) according to the present exemplary embodiment can be performed in any of these processes. Actual control in the maximum gradation limitation processing will be described next.

A case where the maximum gradation limitation processing is performed in the process for conversion into the CMYK data in step 2 will be described first. In this case, the DC controller 274 limits the maximum gradation to be used in the color table. FIG. 8B illustrates an example of the color table that is a conversion table subjected to the maximum gradation limitation processing. The example of FIG. 8B indicates a case where, when the same dither pattern is used for Y and M and accordingly the same screen ruling is used therefor, the area coverage modulation for each of Y and M is limited to 95%. The relationship between the screen ruling and the maximum gradation limit will be described below. When the area coverage modulation for each of Y and M is limited to 95%, the color table is such that the value of each of Y and M corresponding to R having a value of 255 is 242 and a value larger than 242 is not used. In the conversion into CMYK data, the conversion tables illustrated in FIGS. 8A and 8B may not necessarily be used. For example, a function may be set for a value of each of Y and M corresponding to a value of R. Performing the maximum gradation limitation processing in step 2 enables the maximum gradation to be determined before the density correction. Thus, performing the density correction in this state enables halftone control to be performed appropriately without correction of the maximum gradation.

Figure 10:
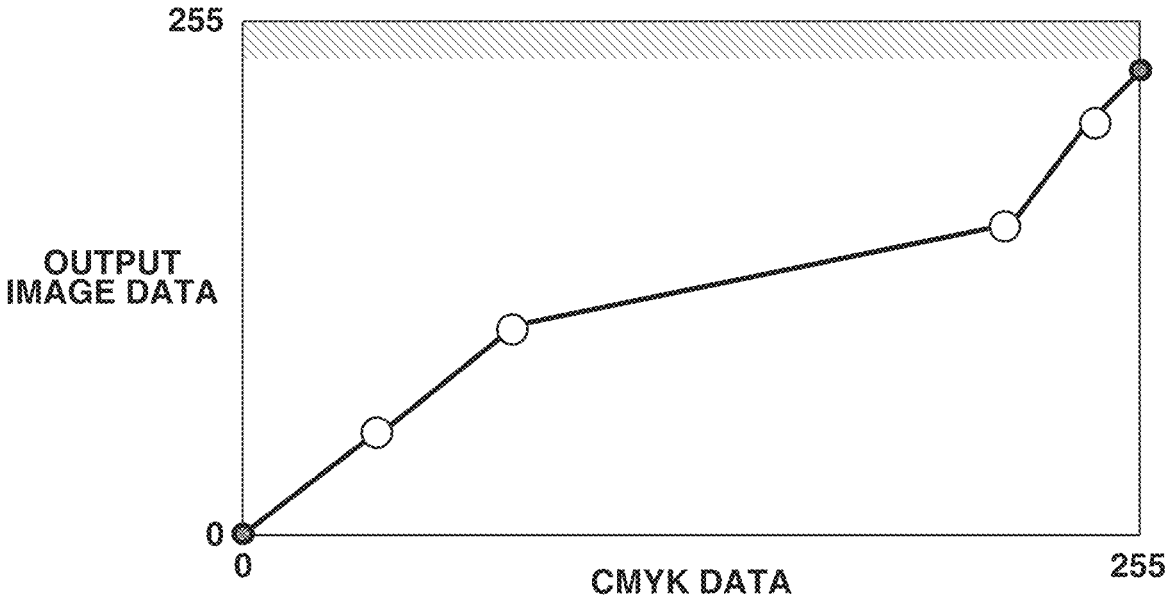
FIG. 10 is a graph illustrating maximum gradation limitation processing performed in the gamma correction according to the first exemplary embodiment.

A case where the maximum gradation limitation processing is performed in step 3 will be described next. FIG. 10 illustrates a result of a gamma correction curve obtained when the maximum gradation limitation processing is performed at the time of the gamma correction. The horizontal axis indicates the CMYK data, and the vertical axis indicates the output image data. In FIG. 10, the shaded portion indicates a limitation region applied when the maximum gradation limitation processing is performed. The output image data is limited with respect to the input CMYK data. In other words, the output image data is limited and the gamma correction is performed so that a target maximum gradation value is obtained.

Figure 11A:
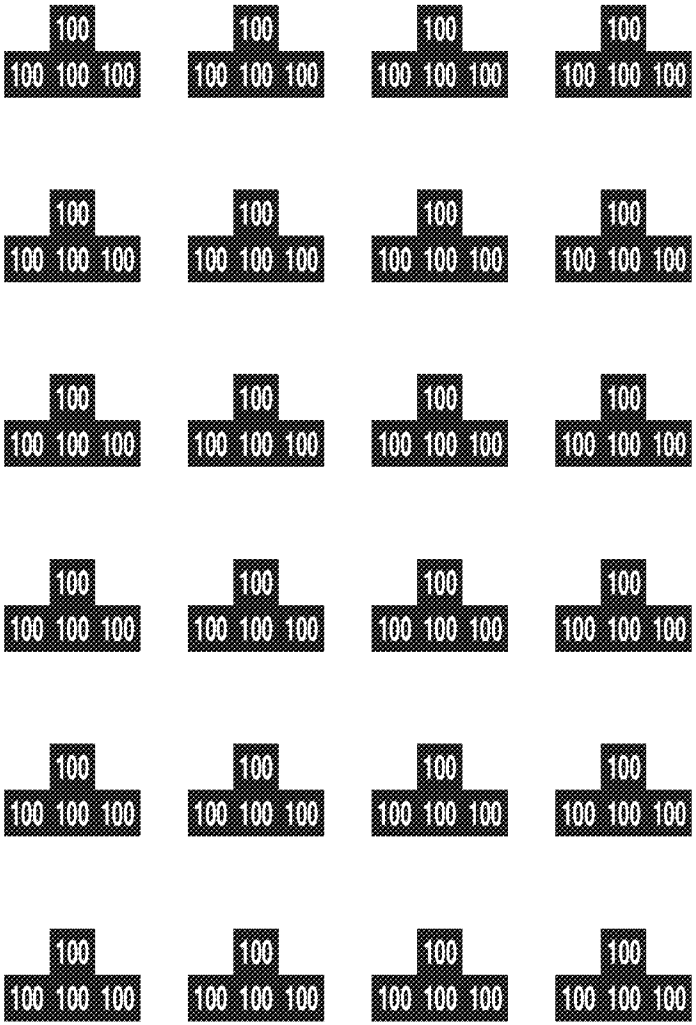
FIGS. 11A and 11B are diagrams illustrating maximum gradation limitation processing performed in dither processing according to the first exemplary embodiment.
Figure 11B:
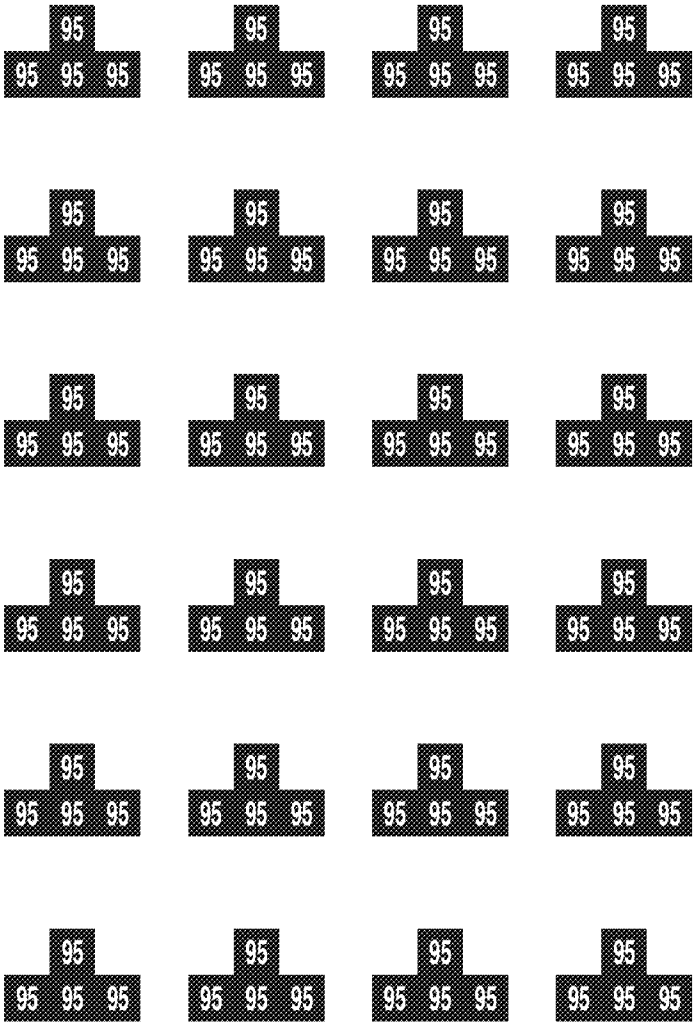

A case where the maximum gradation limitation processing is performed in the dither processing in step 4 will be described next. In FIGS. 11A and 11B, white portions indicate non-exposure regions, and black portions indicate exposure regions. The value indicated in each pixel in the black portions indicates the area coverage modulation ratio of each pixel, and the value of 100 indicates the maximum gradation. FIGS. 11A and 11B illustrate examples of the maximum gradation limitation processing performed when a dither pattern with 150 lpi is used. FIG. 11A illustrates a normal case where the light amount for the exposure regions is set to 100. FIG. 11B, on the other hand, illustrates a case where the maximum gradation value is limited to 95%. The maximum gradation value is limited by setting the light amount for the exposure regions, which is the area coverage modulation ratio of each pixel, to 95.

<6. Relationship Between Line Screen and Toner Amount>

Table 1 illustrates a relationship between the CMYK data and the toner amount on the photosensitive drum 1. More specifically, Table 1 illustrates a result obtained by using a table in which, when the CMYK data has an area coverage modulation of 100%, the number of gradations is 255. The unit of the toner amount in Table 1 is mg/cm$^2$. Table 1 indicates values for yellow as a representative example, which include values of when the screen ruling of the dither pattern is 150 lpi (also referred to as 150 lines) and values of when the screen ruling of the dither pattern is 200 lpi (also referred to as 200 lines). In the present exemplary embodiment, a dot pattern is used as the dither pattern. Even if a line pattern is used as the dither pattern, the relationship between the screen ruling and the toner amount (described below) has a similar tendency to that of the relationship described with reference to the dot pattern. The toner amount in Table 1 is the toner amount after the gamma correction. The toner amount is measured with different screen rulings when the same color table is used and the same gamma correction is performed.

TABLE 1

| CMYK | Toner amount (mg/cm$^2$) Y | |
|---|---|---|
| data | 150 lpi | 200 lpi |
| 100.0% | 0.44 | 0.44 |
| 97.5% | 0.43 | 0.41 |
| 95.0% | 0.39 | 0.36 |
| 92.5% | 0.37 | 0.33 |
| 90.0% | 0.35 | 0.30 |

As a result of intensive studies by the inventors, it is found that, even with the same CMYK data, the toner amounts vary depending on the screen ruling of the dither pattern. More specifically, it is found that the change in the toner amount with respect to the change in the CMYK data is larger with a higher screen ruling. Referring to Table 1, when the CMYK data has an area coverage modulation of 100%, the toner amount is 0.44 mg/cm$^2$ regardless of the screen ruling. When the CMYK data has an area coverage modulation of 95%, the toner amount is 0.39 mg/cm$^2$ with 150 lines and 0.36 mg/cm$^2$ with 200 lines. When the CMYK data has an area coverage modulation of 90%, the toner amount is 0.35 mg/cm$^2$ with 150 lines and 0.30 mg/cm$^2$ with 200 lines. The difference in the toner amount between 150 lines and 200 lines increases as the value of the CMYK data decreases.

A mechanism in which a difference in the toner amount for the toner image to be formed on the surface of the photosensitive drum 1 occurs between screen rulings will be described next.

Figure 12A:
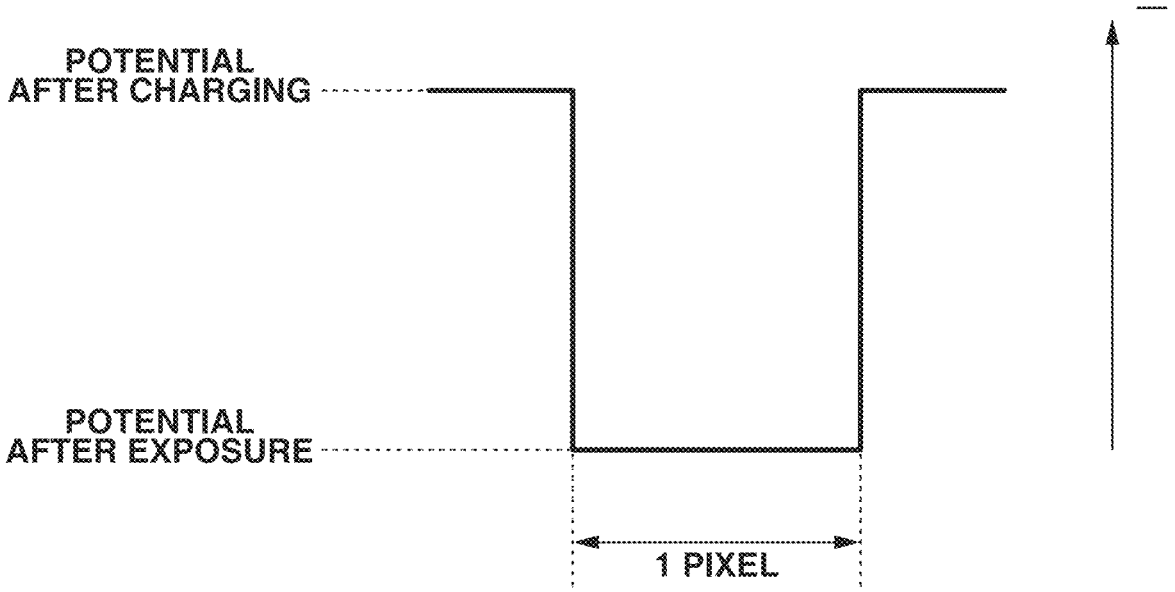
FIGS. 12A and 12B are diagrams illustrating a surface state of a photosensitive drum in forming a latent image of one pixel according to the first exemplary embodiment.
Figure 12B:
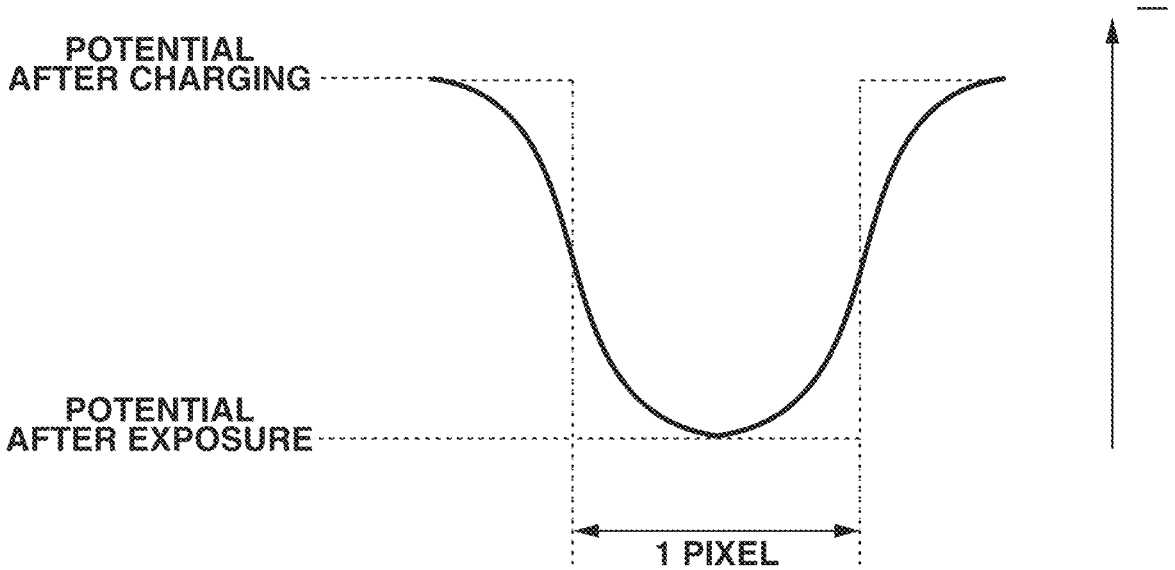

As described above, in the electrophotographic method, the charging of toner and the photosensitive drum 1 is likely to be affected by the ambient temperature and humidity. When the dither matrix method is employed, a stable halftone density expression can be obtained by exposing the arranged pixel blocks to light. When a one pixel region is exposed to light, the potential of the exposure region ideally has a uniform and rectangular shape, as illustrated in FIG. 12A. However, actually, a latent image is formed with a U-shaped potential having the center of the exposure region as a peak, and the potential is formed protruding from a predetermined image region. This is because the intensity of light emitted by the exposure unit 3 is distributed centering on the peak. In this way, since the latent image is actually formed not with a rectangular potential but with a U-shaped potential, exposing the pixel blocks to light increases the ratio of regions having a predetermined potential.

A dither pattern having 150-line dither matrices and a dither pattern having 200-line dither matrices will be considered next. The time period during which pixel blocks in the 200-line dither matrices are exposed to light is shorter than the time period during which pixel blocks in the 150-line dither matrices are exposed to light. In other words, the 200-line dither matrices include smaller pixel blocks than the 150-line dither matrices. With smaller pixel blocks, the interval between the pixel blocks is short and hence the potential protruding from the exposed pixels causes interference in non-exposure portions. Thus, when a latent image is formed, part of toner is developed also in the non-exposure portions. On the other hand, in the 150-line dither matrices, the pixel blocks to be exposed are larger than those in the 200-line dither matrices. However, the interval between the pixel blocks is longer than that in the 200-line dither matrices. Thus, the 150-line dither matrices cause less interference due to the potential protruding from the exposed pixels in non-exposure portions, and have less ratio of developed toner in the non-exposure portions than the 200-line dither matrices. As described above, even with the same CMYK data, in the vicinity of the maximum gradation value where the ratio of non-exposure portions is small in the dither matrices, the 150-line dither matrices cause less interference due to the potential protruding from the exposed pixels in the non-exposure portions than the 200-line dither matrices. Since the 150-line dither matrices cause less interference than the 200-line dither matrices, an attempt to provide gradations of the same CMYK data with both the 150-line dither matrices and the 200-line dither matrices leads to a condition that the 150-line dither matrices require a larger amount of toner to be developed on the photosensitive drum 1 than the 200-line dither matrices. Thus, particularly in comparison using the same CMYK data in the vicinity of the maximum gradation value, the dither matrices with a smaller screen ruling requires a larger amount of toner to be developed on the photosensitive drum 1 than the dither matrices with a larger screen ruling.

Figure 13A:
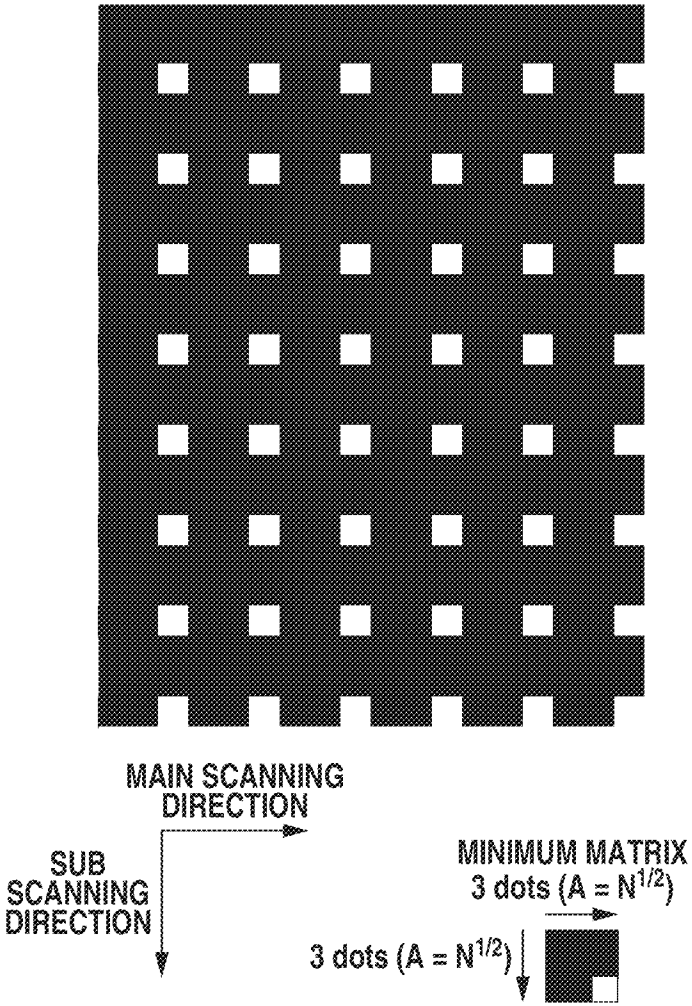
FIGS. 13A and 13B are diagrams each illustrating a dot growth state of the dither matrix in a dot pattern according to the first exemplary embodiment.
Figure 13B:
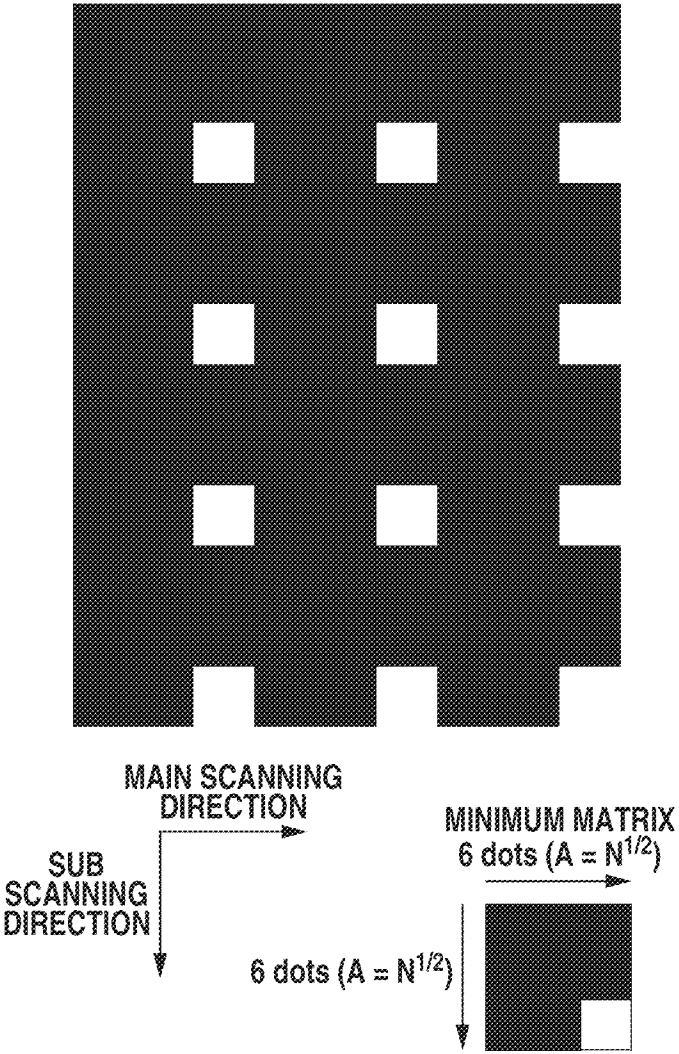

The above-described contents will be considered in detail. FIG. 13A illustrates a dot pattern growth state in the dither pattern with a larger screen ruling, and FIG. 13B illustrates a dot pattern growth state in the dither pattern with a smaller screen ruling. When a high gradation region is reproduced, smaller regions are exposed to light in the dither pattern with a larger screen ruling than in the dither pattern with a smaller screen ruling. More specifically, as illustrated in FIG. 13A, in the dither pattern with a large screen ruling, since the pixel area N of the dither matrix is small, dots are often grown in such a manner that one dot region is finely divided into an exposure portion and a non-exposure portion. In this case, the exposure unit 3 quickly switches ON/OFF of exposure. The smaller the region to be exposed to light is, the harder the latent image formation by switching the ON/OFF of exposure is. Accordingly, the potential protrusion into the non-image regions is more likely to occur as described above. On the other hand, as illustrated in FIG. 13B, in the dither pattern with a small screen ruling, since the pixel area N of the dither matrix is large, the exposure is often controlled to be ON or OFF for the entire one dot region. Thus, the exposure unit 3 smoothly switches the ON/OFF of exposure to form the latent image in the exposure portions smoothly, so that the potential protrusion into the non-image regions is unlikely to occur.

Figure 14B:
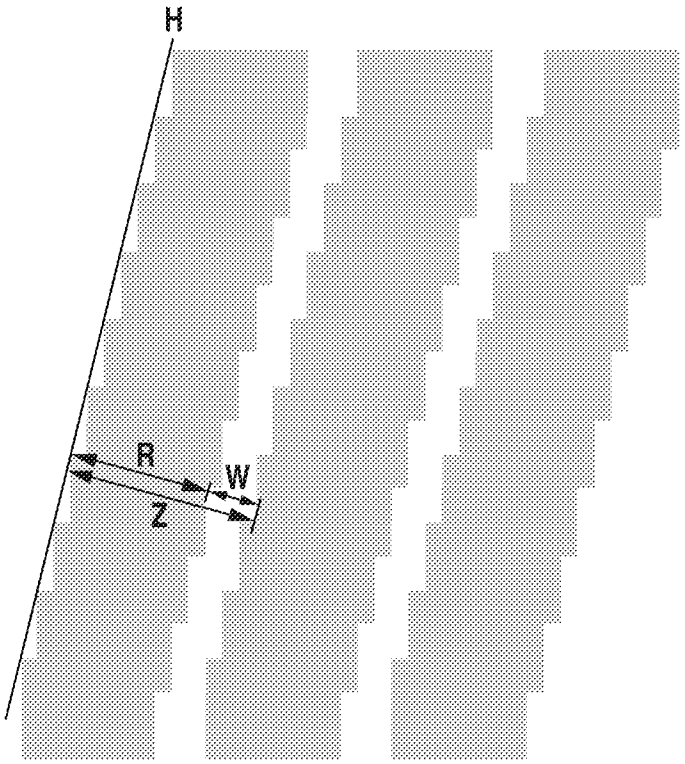
FIGS. 14A and 14B are diagrams each illustrating a line growth state of the dither matrix in a line pattern according to the first exemplary embodiment.
Figure 14A:
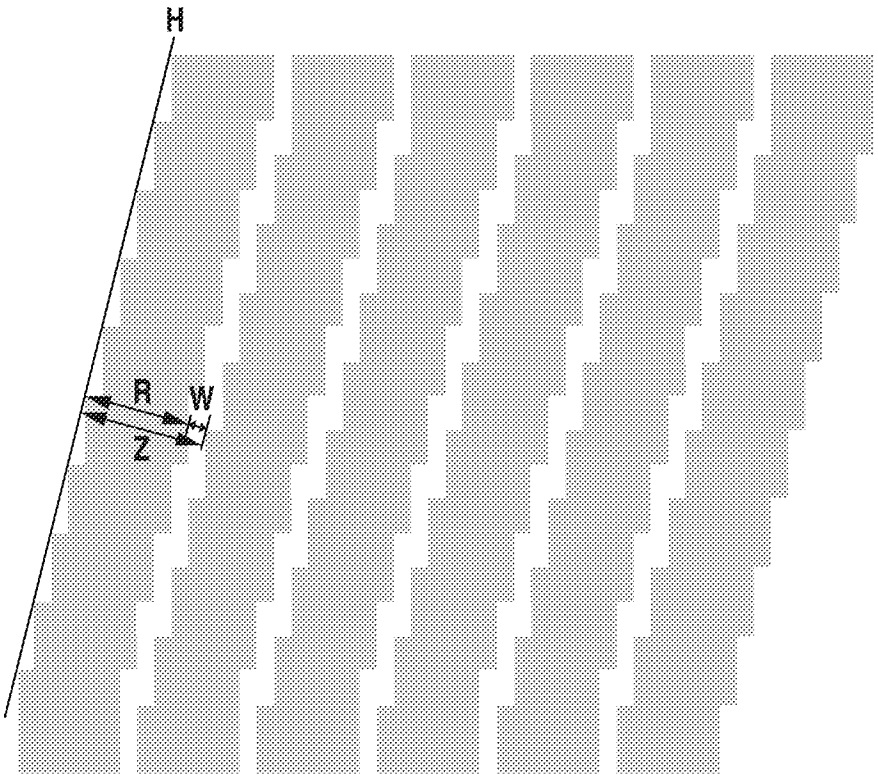

The above-described concept with the dot pattern also applies to the line pattern. The exposure unit 3 switches the ON/OFF of exposure more quickly for the dither pattern with a larger screen ruling illustrated in FIG. 14A than for the dither pattern with a smaller screen ruling illustrated in FIG. 14B. The smaller the region to be exposed to light is, the harder the latent image formation by switching the ON/OFF of exposure is, and the potential protrusion into the non-image regions is more likely to occur.

<7. Setting of Maximum Gradation Value>

Setting of the maximum gradation value according to the present exemplary embodiment will be described next using yellow as an example. In the present exemplary embodiment, to set the maximum toner amount for the image formation to 0.80 mg/cm$^2$, the maximum gradation value is limited so that the toner amount on the photosensitive drum 1 at the time of the secondary color formation is 0.40 mg/cm$^2$ in each image forming unit. This can prevent defective fixing due to the excessive toner amount.

Referring to Table 1, when the 150-line dither matrices are used, setting the area coverage modulation for yellow to about 95% enables the toner amount on the photosensitive drum 1 to be adjusted to 0.40 mg/cm$^2$. When the 200-line dither matrices are used, setting the maximum gradation value to 97% enables the toner amount on the photosensitive drum 1 to be adjusted to 0.40 mg/cm$^2$.

In the present exemplary embodiment, to adjust the toner amount depending on the screen ruling of the dither pattern, the DC controller 274 limits the maximum gradation value, thereby enabling development using the target toner amount on the photosensitive drum 1. This means that, after the development on the photosensitive drum 1*a* by the developing roller 42*a*, residual toner exists on the developing roller 42*a*. Referring to Table 1, when the screen ruling is 150 lpi for yellow, the target toner amount on the photosensitive drum 1*a* is 0.40 mg/cm$^2$, whereas the toner amount is 0.44 mg/cm$^2$ when the maximum gradation value is 100%. Thus, if the maximum gradation value is set to 95%, 0.040 mg/cm$^2$ of residual toner exists on the developing roller 42*a*. The developing roller 42*a* is driven to rotate at 300 mm/sec., which is 1.5 times faster than the process speed of the photosensitive drum 1*a*, i.e., 200 mm/sec. Accordingly, residual toner amount per unit area on the developing roller 42*a* is 0.040/1.5=0.027 mg/cm$^2$. When the screen ruling is 200 lpi, if the maximum gradation value is set to 97%, the residual toner amount is also 0.027 mg/cm$^2$. Changing the limit value of the maximum gradation value depending on the screen ruling enables development using the target toner amount on the photosensitive drum 1.

As described above, the image forming apparatus 100 according to the present exemplary embodiment includes the following components.

The image forming apparatus 100 includes the photosensitive drum 1, the exposure unit 3 that exposes the surface of the photosensitive drum 1 to light to form an electrostatic latent image, and the developing roller 42 (42*a* to 42*d*) that develops the electrostatic latent image with toner to form a toner image. The image forming apparatus 100 further includes the control unit 274 that uses the exposure unit 3 to control the maximum gradation value of the toner image based on the repetition length of the dither pattern, in image formation based on the input image data to be input. The control unit 274 performs the control so that the maximum gradation value is larger when a first dither pattern having a first length as the repetition length is used than when a second dither pattern having a second length longer than the first length as the repetition length is used.

When the dither pattern is formed of a dot pattern, the screen ruling L1, which is expressed in lpi, of the dot pattern is represented by $L1=I/N^{1/2}$, where N denotes, in units of dots, the minimum unit pixel area of the repetitive pattern in the dot pattern and I denotes, in units of dpi, the image resolution. Therefore, the control unit 274 performs the control so that the maximum gradation value is larger when the first dither pattern is used than when the second dither pattern in which the screen ruling L1 of the dot pattern is smaller than that in the first dither pattern is used.

A case where the dither pattern is formed of a line pattern will be considered next. The repetition length of the repetitive pattern in the line pattern is the sum Z (which is expressed in dots) of the number of pixels between the line pattern and the line pattern closest thereto and the number of pixels corresponding to the short width of the line pattern. The screen ruling L2 of the line pattern in the dither pattern is represented by L2=I/Z. Therefore, the control unit 274 performs the control so that the maximum gradation value is larger when the first dither pattern is used than when the second dither pattern in which the screen ruling L2 of the line pattern is smaller than that in the first dither pattern is used.

As described above, in the present exemplary embodiment, setting a larger maximum gradation value for each color with a larger screen ruling enables the toner amount on the photosensitive drum 1 to be adjusted to a target value. As a result, the toner amount on the photosensitive drum 1 is made approximately constant regardless of the screen ruling, so that defective fixing can be prevented.

Filtering processes for various kinds of image data, which are executed between the selection of the image to be printed and the execution of printing, have been described above with reference to the flowchart illustrated in FIG. 7. However, the execution order of the filtering processes is not limited to the above-described one. Even if the filtering processes are executed in different order, performing the maximum gradation adjustment on any one of the filtering processes enables obtaining a similar effect. Similar filtering processes may not necessarily be performed. Another filtering process may be provided, and the maximum gradation adjustment may be performed in the process.

While in the present exemplary embodiment, the example in which the screen ruling is 150 lines or 200 lines has been described, the effective screen ruling is not limited thereto. Even if another screen ruling is selected, setting the maximum gradation value depending on the screen ruling enables obtaining a similar effect.

When the maximum gradation value is changed, it is desirable to set the maximum gradation value to 70% or more which maintains the gradation on the high gradation side. More specifically, it is desirable to set the maximum gradation value to 85% or more. In a case where the area coverage modulation of the dither pattern is changed from 0% to 100%, the repetitive pattern of the dither pattern is repeated with a fixed repetition length in a state where the area coverage modulation is about 70%. More specifically, the repetitive pattern of the dither pattern may not be uniquely determined in a state where the area coverage modulation of the dither pattern is smaller than 70%. It is also known that, in a region where the area coverage modulation is larger than 85%, the sensitivity to the toner bearing amount depending on the repetition length of the dither pattern is particularly high.

While the example in which the target toner amount is set to 0.40 mg/cm$^2$ has been described above, the target toner amount is not limited thereto in decreasing the maximum gradation value.

In the first exemplary embodiment, the method in which the maximum gradation limitation processing is performed depending on the screen ruling of the dither pattern has been described using yellow as an example. In a second exemplary embodiment, a case will be described in which a dither pattern with a different screen ruling is set for each of yellow, magenta, and cyan. The configuration of the image forming apparatus 100 other than the dither pattern and the dither matrix is similar to that according to the first exemplary embodiment.

Also in the present exemplary embodiment, to adjust the maximum toner amount for the image formation to 0.80 mg/cm$^2$, the DC controller 274 limits the maximum gradation value so that the toner amount for each color in the secondary color formation is 0.40 mg/cm$^2$.

In the present exemplary embodiment, the screen ruling is set to 200 lpi for yellow and 150 lpi for each of magenta and cyan. To prevent the occurrence of a moire image due to interference between dither patterns, a different screen ruling is used depending on the color. The DC controller 274 changes not only the screen ruling but also the angle of the repetitive pattern of the dither matrix (also referred to as the screen angle).

Table 2 illustrates, for each of yellow, magenta, and cyan, a relationship between the CMYK data and the toner amount on the photosensitive drum 1. In Table 2, the unit of the toner amount on the photosensitive drum 1 is mg/cm$^2$.

TABLE 2

| CMYK data | Toner amount (mg/cm$^2$) Y 200 lpi | M 150 lpi | C 150 lpi | K 120 lpi |
|---|---|---|---|---|
| 100.0% | 0.44 | 0.43 | 0.43 | 0.43 |
| 97.5% | 0.41 | 0.42 | 0.42 | 0.43 |
| 95.0% | 0.36 | 0.41 | 0.41 | 0.42 |
| 92.5% | 0.33 | 0.40 | 0.40 | 0.41 |
| 90.0% | 0.30 | 0.39 | 0.39 | 0.40 |

Referring to Table 2, to adjust the toner amount on the photosensitive drum 1 to 0.40 mg/cm$^2$, the maximum gradation limit value of the CMYK data is set to 97.0% for yellow, 92.5% for magenta, 92.5% for cyan, and 90.0% for black. In the example of Table 2, the change in the toner amount on the photosensitive drum 1 with respect to the change in the CMYK data differs depending on the screen ruling of the dither pattern. In addition, when the CMYK data has an area coverage modulation of 100%, the toner amount on the photosensitive drum 1 is different for each color. Thus, the maximum gradation value is specified for each color in consideration of these factors.

A case where such maximum gradation control as described in the present exemplary embodiment is not performed is referred to as a first comparative example. As described in Table 2, in the first comparative example, the screen ruling of the yellow dither pattern is 200 lpi, and the screen ruling of the magenta dither pattern is 150 lpi. In this case, referring to Table 2, the toner amount on the photosensitive drum 1 for the maximum gradation in the secondary color formation is 0.44 mg/cm$^2$ for yellow and 0.43 mg/cm$^2$ for magenta and hence the maximum toner amount for the image formation is 0.87 mg/cm$^2$. In this case, the toner bearing amount on the transfer material P exceeds the target value of 0.80 mg/cm$^2$, which causes defective fixing.

In addition, a case where the maximum gradation value is limited by a predetermined amount (in 7.5% steps) in the maximum gradation control regardless of the dither pattern is referred to as a second comparative example. As described in Table 2, in the second comparative example, the screen ruling of the yellow dither pattern is 200 lpi, and the screen ruling of the magenta dither pattern is 150 lpi. In this case, referring to Table 2, the toner amount on the photosensitive drum 1 for the maximum gradation in the secondary color formation is 0.33 mg/cm$^2$ for yellow and 0.40 mg/cm$^2$ for magenta and hence the maximum toner amount for the image formation is 0.73 mg/cm$^2$. Thus, if the maximum gradation value for the yellow dither pattern is limited by the same amount as that for the magenta dither pattern with a smaller screen ruling, the toner bearing amount deviates from the target value.

As described above, performing the setting according to the present exemplary embodiment enables the toner amount on the photosensitive drum 1 to be adjusted to a target value even if the dither pattern with a different screen ruling is used for each color. As for the method for limiting the maximum gradation value, a method similar to that according to the first exemplary embodiment is also applicable in the present exemplary embodiment.

While in the present exemplary embodiment, the description has been given assuming that the yellow dither pattern has the largest screen ruling and that the magenta and cyan dither patterns have the same screen ruling, the screen ruling may be reversed. In addition, even if the screen ruling differs from color to color, the maximum gradation value may be limited for each color depending on the screen ruling. The dither pattern may be formed of a dot pattern or a line pattern.

While the target toner amount is set to 0.40 mg/cm$^2$ for both colors, the target toner amount is not limited thereto in decreasing the maximum gradation value. The target toner amount may be changed for each color. While the maximum toner amount for the image formation is set to 0.80 mg/cm$^2$, the maximum toner amount is not limited thereto.

The halftone expression method using the dither matrix method is performed with a dot pattern or a line pattern. Thus, when a dither pattern with a small screen ruling is used, the dot pattern or the line pattern may be visually recognized. If the screen ruling is small, the print quality of a printed image such as a printed picture may be grainy. To reduce the grainy effect, for example, increasing the screen ruling of the dither pattern enables obtaining a high-resolution image. However, for example, when a text document is printed, a high-resolution image may not be necessarily required. Thus, a third exemplary embodiment is characterized in that a normal mode or a high-definition mode can be selected on a printer driver. In the third exemplary embodiment, a method for setting the maximum gradation value when a dither pattern with a different screen ruling is used for each print mode will be described.

Figure 15:
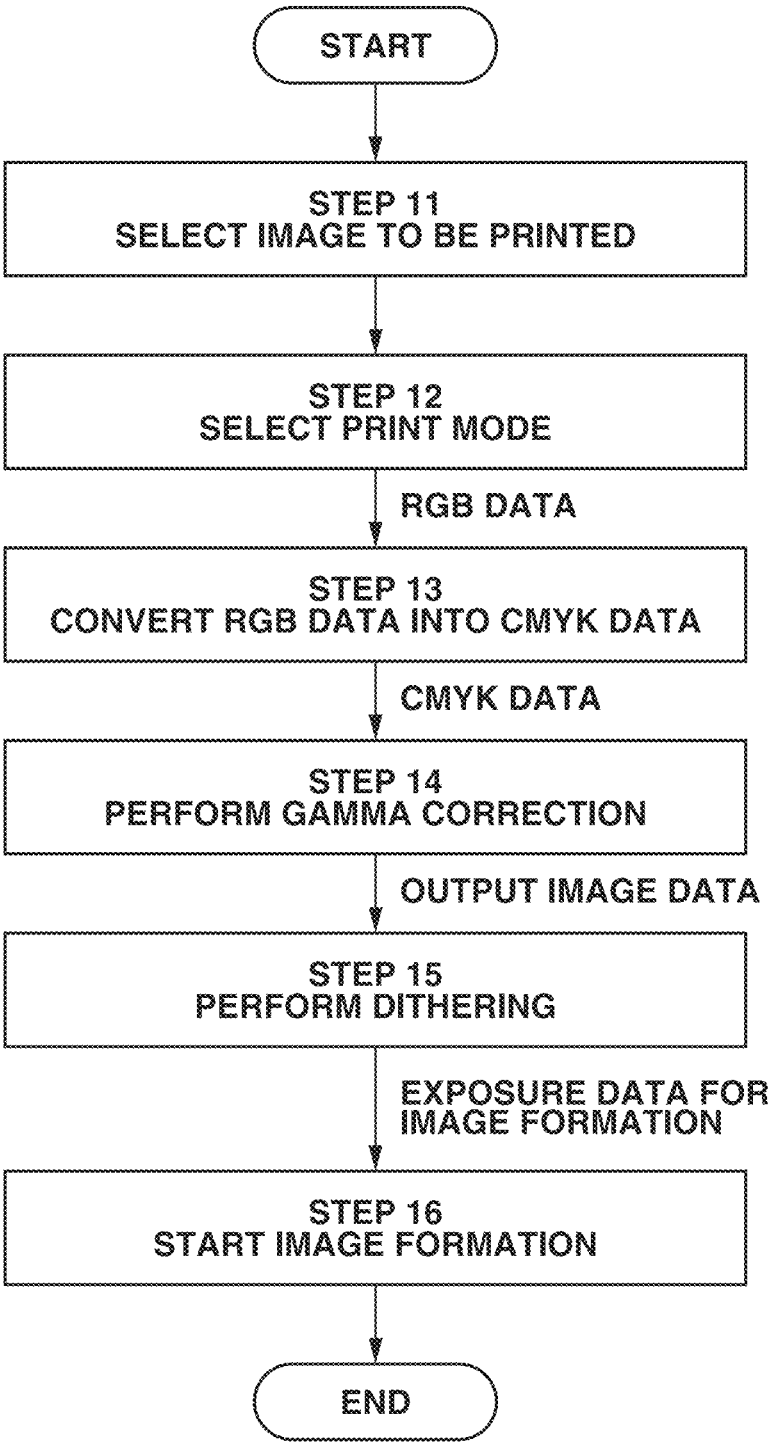
FIG. 15 is a flowchart illustrating processing before image formation according to a third exemplary embodiment.

FIG. 15 is a flowchart illustrating processing for setting a dither pattern and setting a maximum gradation value in a case where the dither pattern to be used is changed depending on the print mode.

In step 11, the user selects on the PC 271 the image to be printed, and CMYK data is generated. In step 12, the user selects the print mode on the PC 271. The following description will be made on the premise that the user selects the high-definition mode. The dither pattern to be used is determined depending on the selected print mode. The print mode may be selected by the user or automatically selected based on the CMYK data. Table 3 is a list of screen rulings of yellow, magenta, and cyan dither patterns in the normal mode and in the high-definition mode. In the present exemplary embodiment, in the normal mode, the screen ruling is 200 lpi for yellow, 150 lpi for magenta, 150 lpi for cyan, and 120 lpi for black. In the high-definition mode, the screen ruling is 200 lpi for yellow, 175 lpi for magenta, 175 lpi for cyan, and 150 lpi for black. To reduce the grainy effect for magenta, cyan, and black, the screen rulings for these colors are made larger in the high-definition mode than those in the normal mode.

TABLE 3

| Unit: 1pi | Yellow | Magenta | Cyan | Black |
|---|---|---|---|---|
| Normal mode | 200 | 150 | 150 | 120 |
| High-definition mode | 200 | 175 | 175 | 150 |

In step 13, the formatter 273 converts the RGB data into CMYK data by using a color table set for the high-definition mode.

In step 14, the CMYK data is subjected to the gamma correction to generate output image data. In the present exemplary embodiment, the gamma correction dedicated for the high-definition mode is performed. In the gamma correction dedicated for the high-definition mode, density control may be performed by detecting the test patch 400 formed using the dither pattern for the high-definition mode. Alternatively, gamma correction dedicated for the high-definition mode may be obtained through prediction based on the gamma correction obtained in density control in the normal mode.

In step 15, exposure data for image formation, which corresponds to the dither pattern for the high-definition mode, is generated so that exposure is performed at the area coverage modulation ratio corresponding to the output image data.

In step 16, based on the exposure data for image formation, the exposure unit 3 exposes the photosensitive drum 1 to light to form an electrostatic latent image. Then, after a series of electrophotographic image forming processes, a print image is formed on a medium such as the transfer material P. Similarly to the first exemplary embodiment, the maximum gradation limitation processing according to the present exemplary embodiment may be performed in any one of the filtering processes in steps 13 to 15 in FIG. 15.

Table 4 illustrates the toner amount on the photosensitive drum 1 with respect to the maximum gradation value of the exposure data for image formation in the high-definition mode.

TABLE 4

| | Toner amount (mg/cm$^2$) | | | |
|---|---|---|---|---|
| CMYK data | Y 200 lpi | M 175 lpi | C 175 lpi | K 150 lpi |
| 100.0% | 0.44 | 0.43 | 0.43 | 0.43 |
| 97.5% | 0.41 | 0.41 | 0.41 | 0.41 |
| 95.0% | 0.36 | 0.39 | 0.39 | 0.40 |
| 92.5% | 0.33 | 0.36 | 0.36 | 0.38 |
| 90.0% | 0.30 | 0.33 | 0.33 | 0.37 |

Referring to Table 4, to adjust the toner amount on the photosensitive drum 1 for the maximum gradation to 0.40 mg/cm$^2$, the maximum gradation value of the exposure data for image formation is set to 97.0% for yellow, 96.5% for magenta, 96.5% for cyan, and 95.0% for black.

Table 5 compares the maximum gradation values of the exposure data for image formation based on the results of the maximum gradation limitation processing in the normal mode and in the high-definition mode.

TABLE 5

| | Yellow | Magenta | Cyan | Black |
|---|---|---|---|---|
| Normal mode | 97.0% | 92.5% | 92.5% | 90.0% |
| High-definition mode | 97.0% | 96.5% | 96.5% | 95.0% |

In the present exemplary embodiment, the maximum gradation values for magenta, cyan, and black with increased screen rulings in the high-definition mode are larger than those in the normal mode.

As described above, in the high-definition mode according to the present exemplary embodiment, the maximum gradation value for a color with an increased screen ruling of the dither pattern is set to be larger than that in the normal mode, so that the toner amount on the photosensitive drum 1 can be adjusted to the target value even if the screen ruling is changed by the selection of a print mode.

In the present exemplary embodiment, not only in the normal mode but also in the high-definition mode, the maximum gradation value is set so that the toner amount on the photosensitive drum 1 for the maximum gradation is 0.40 mg/cm$^2$. However, the toner amount for the maximum gradation may not necessarily be set to 0.40 mg/cm$^2$ and may be set to the allowable toner amount or below depending on the change of the print mode. For example, decreasing the process speed depending on the change of the print mode enables increasing the fixable toner amount on the photosensitive drum 1. In the image forming apparatus 100 according to the present exemplary embodiment, when the process speed is 200 mm/sec., the fixable toner amount on the photosensitive drum 1 is 0.40 mg/cm$^2$. Thus, decreasing the process speed to 100 mm/sec. enables fixing a toner amount of up to 0.42 mg/cm$^2$ on the photosensitive drum 1. In this case, the maximum gradation value is set so that the toner amount on the photosensitive drum 1 is 0.42 mg/cm$^2$.

As described above, the image forming apparatus 100 according to the present exemplary embodiment has a plurality of modes including a first mode and a second mode. In the first mode, a first dither pattern having a first length as the repetition length is used for at least one of a plurality of coloring materials. In the second mode, a second dither pattern having a second length longer than the first length as the repetition length is used for the at least one of the plurality of coloring materials. The mode can be suitably selected between the first mode and the second mode.

While in the present exemplary embodiment, the case where the high-definition mode in which the screen ruling of the dither pattern is large is set in order to reduce the grainy effect of an image has been described, the mode to be used is not limited to a mode having a larger screen ruling than the normal mode. Also for a mode having a smaller screen ruling, the maximum gradation value most suitable for the screen ruling may be set. For example, when printing is performed focusing on stable image quality in an environment where image defects are likely to occur because of ambient conditions different from normal office conditions, such as a high-temperature and high-humidity environment, or a low-temperature and low-humidity environment, a print mode may be set with a smaller screen ruling.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-142115, filed Aug. 25, 2020, which is hereby incorporated by reference herein in its entirety.

What is claimed is:

1. An image forming apparatus comprising:

an image bearing member;

an exposure unit configured to expose a surface of the image bearing member to light to form an electrostatic latent image;

a developing member configured to develop the electrostatic latent image formed on the surface of the image bearing member by the exposure unit, by using toner, to form a toner image; and a control unit configured to perform control, wherein, in image formation based on input image data to be input, the control unit is configured to use the exposure unit to control a maximum gradation value of the toner image to be formed on the surface of the image bearing member, based on a repetition length of a dither pattern, wherein the control unit performs control so that the maximum gradation value is larger in a case where a first dither pattern having a first length as the repetition length is used than in a case where a second dither pattern having a second length longer than the first length as the repetition length is used.

2. The image forming apparatus according to claim 1, wherein the dither pattern is formed of a dot pattern, and a screen ruling L1 of the dot pattern in the dither pattern is represented by $L1=I/N^{1/2}$, where N denotes, in units of dots, a minimum unit pixel area of a repetitive pattern in the dot pattern and I denotes, in units of dots per inch (dpi), an image resolution, and where the screen ruling L1 is expressed in lines per inch (lpi), and wherein the control unit performs control so that the maximum gradation value is larger in the case where the first dither pattern is used than in the case where the second dither pattern in which the screen ruling L1 of the dot pattern is smaller than the screen ruling L1 of the dot pattern in the first dither pattern is used.

3. The image forming apparatus according to claim 1, wherein the dither pattern is formed of a line pattern, and the repetition length of a repetitive pattern in the line pattern is a sum Z of (i) a number of pixels between the line pattern and the line pattern closest thereto, and (ii) a number of pixels corresponding to a short width of the line pattern, where the sum Z is expressed in dots, and a screen ruling L2 of the line pattern in the dither pattern is represented by L2=I/Z, where I denotes, in units of dpi, the image resolution and the screen ruling L2 is expressed in lpi, and wherein the control unit performs control so that the maximum gradation value is larger in the case where the first dither pattern is used than in the case where the second dither pattern in which the screen ruling L2 of the line pattern is smaller than the screen ruling L2 of the line pattern in the first dither pattern is used.

4. The image forming apparatus according to claim 1, further comprising a conversion unit configured to convert color information of the input image data into color information for an expression with a plurality of coloring materials, wherein the control unit uses the conversion unit to control the maximum gradation value for each of the plurality of coloring materials.

5. The image forming apparatus according to claim 1, further comprising a conversion table configured to convert color information of the input image data into color information for an expression with a plurality of coloring materials, wherein the control unit controls the maximum gradation value by adjusting a value in the conversion table.

6. The image forming apparatus according to claim 1, wherein, in a case where the input image data is converted using a look-up table to acquire input image data subjected to the conversion, the control unit controls the maximum gradation value of the input image data subjected to the conversion using the look-up table.

7. The image forming apparatus according to claim 1, wherein the maximum gradation value is set for each color.

8. The image forming apparatus according to claim 1, wherein a first mode or a second mode is selectable for at least one of a plurality of coloring materials, wherein the first mode uses the first dither pattern having the first length as the repetition length, and the second mode uses the second dither pattern having the second length longer than the first length as the repetition length.

* * * * *